US007247174B2

(12) United States Patent
Scheffler et al.

(10) Patent No.: US 7,247,174 B2
(45) Date of Patent: Jul. 24, 2007

(54) AMPHOTERIC FLUORESCENT WHITENING AGENTS

(75) Inventors: Goetz Scheffler, Grenzach-Wyhlen (DE); Peter Rohringer, Schönenbuch (CH); Ian John Fletcher, Rheinfelden (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 120 days.

(21) Appl. No.: 10/534,315

(22) PCT Filed: Nov. 11, 2003

(86) PCT No.: PCT/EP03/12583

§ 371 (c)(1),
(2), (4) Date: May 9, 2005

(87) PCT Pub. No.: WO2004/046293

PCT Pub. Date: Jun. 3, 2004

(65) Prior Publication Data

US 2006/0155124 A1 Jul. 13, 2006

(30) Foreign Application Priority Data

Nov. 19, 2002 (EP) ..... 02405998

(51) Int. Cl.
*C11D 3/42* (2006.01)

(52) U.S. Cl. ..... 8/648; 510/461

(58) Field of Classification Search ..... 8/648; 510/461

See application file for complete search history.

(56) References Cited

U.S. PATENT DOCUMENTS

| | | | | |
|---|---|---|---|---|
| 3,951,965 | A * | 4/1976 | Mengler et al. | 544/193.2 |
| 4,263,176 | A * | 4/1981 | Martini et al. | 510/394 |
| 5,945,396 | A | 8/1999 | Eckhardt et al. | 510/521 |
| 5,976,410 | A | 11/1999 | Rohringer et al. | 252/301.21 |
| 6,165,973 | A | 12/2000 | Baker | 510/516 |
| 2004/0074021 | A1 | 4/2004 | Farrar et al. | 8/648 |

FOREIGN PATENT DOCUMENTS

| | | | |
|---|---|---|---|
| EP | 413926 | A1 * | 2/1991 |
| EP | 0850934 | | 7/1998 |
| FR | 1479540 | * | 5/1967 |
| WO | 02/055646 | | 7/2002 |

* cited by examiner

*Primary Examiner*—John R. Hardee
(74) *Attorney, Agent, or Firm*—Shiela A. Loggins

(57) ABSTRACT

The present invention provides novel bis-triazinylaminostilbene amphoteric fluorescent whitening agents, comprising both individual components and mixtures thereof, a process for their preparation, intermediates useful for their preparation and use of the fluorescent whitening agents for the fluorescents whitening of paper.

5 Claims, No Drawings

AMPHOTERIC FLUORESCENT WHITENING AGENTS

The present invention relates to amphoteric bis-triazinylaminostilbene fluorescent whitening agents (FWA's), a process for their preparation and the use thereof for fluorescent whitening of synthetic or natural organic materials, In particular, paper.

The most commonly used types of fluorescent whitening agent for the fluorescent whitening of paper are those belonging to the class of di-, tetra- or hexasulphonic acid derivatives of bis-triazinylaminostilbenes, which are anionic in nature. Modern paper-making techniques, however, generally employ cationic polymers as assistants, for example, as retention agents or dewatering aids, in particular, during the production of recycling papers, which, most probably contain residual amounts of anionic FWA's. The presence of cationic polymers, however, results in quenching of the fluorescence of anionic FWA's, which is clearly disadvantageous. Consequently, there is a need for a type of FWA, which is not quenched by such polymers and, in addition, is combinable with anionic FWA's.

Surprisingly, it has now been found that certain novel amphoteric FWA's are neither detrimentally affected by the presence of cationic polymers nor by the presence of residual amounts of anionic FWA's and also exhibit excellent whitening properties when applied to paper.

Accordingly, in a first aspect, the present invention provides novel amphoteric fluorescent whitening agents, which comprise a mixture of compounds of the formulae (1a)

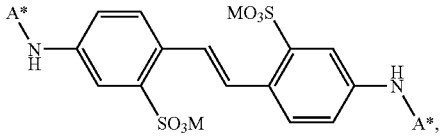

(1b)

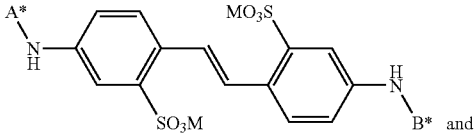

and (1c)

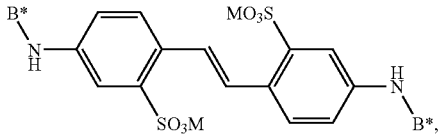

in which

A* represents a group of the formula

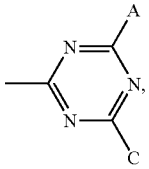

wherein

A represents —X—Y—$NR_3R$ % and

C is —$NR_1R_2$ and

B* represents a group of the formula

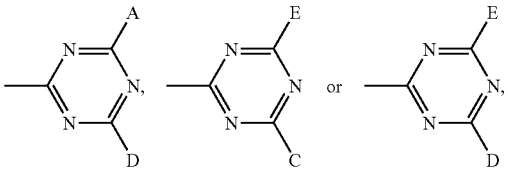

wherein

D represents —$NR_5R_6$ and

E represents —$X_1$—$Y_1$—$NR_7R_8$, whereby

X and $X_1$ each, independently of each other, represent —O— or —NH—,

Y and $Y_1$ each, independently of each other, represent a straight-chain $C_2$-$C_8$alkylene or branched $C_3$-$C_8$alkylene chain, which may be interrupted by one or two nitrogen, oxygen or sulphur atoms or represent a 5- or 6-membered cycloaliphatic ring, preferably cyclohexyl, $R_1$, $R_2$, $R_5$ and $R_6$ each independently of each other, represent hydrogen, $C_1$-$C_8$alkyl, $C_2$-$C_4$hydroxyalkyl, $C_1$-$C_4$alkoxy$C_1$-$C_4$alkyl, phenyl, which is unsubstituted or substituted by halogen, $C_1$-$C_4$alkoxy, $C_1$-$C_4$alkyl or sulphonamido, or $R_1$ and $R_2$ and/or $R_5$ and $R_6$, together with the nitrogen atom to which they are attached, complete a morpholino-, piperidino- or pyrrolidino-ring, $R_3$, $R_4$, $R_7$ and $R_8$, each independently of each other, represent hydrogen, $C_1$-$C_4$alkyl, $C_2$-$C_4$hydroxyalkyl or $R_3$ and $R_4$ and/or $R_7$ and $R_8$, together with the nitrogen atom to which they are attached, complete a morpholino-, piperidino- or pyrrolidino-ring and M represents hydrogen, an alkaline or alkaline earth metal, ammonium or alkyl ammonium.

Amphoteric compounds of formula (1a)-(1c) may exist either in the form of an internal or external salt. Thus, for example, in the case in which M in the above formulae represents hydrogen, compounds (1a)-(1c) may exist as an equilibrium mixture of a neutral molecule and of a zwitterion, wherein M designates a negative charge in the form of $SO_3^-$, whilst the proton resides on the amine residues in the form of ammonium salts —$N^+HR_3R_4$ and —$N^+HR_7R_8$. Consequently, in order for the compounds of formulae (1a)-(1c) to be truly amphoteric in character, it is necessary for the total number of acidic groups and of basic amino groups present in the molecule to be equal. Since the diaminostilbene disulphonic acid moiety already contains two sulphonic acid groups, it is preferable that no further acidic groups are present in the molecules (1a)-(1c) and, furthermore, that they are substituted with two amino groups which are of sufficiently high basicity to be capable of forming zwitterions i.e. in addition to amino groups attached directly to a triazine ring.

In one preferred aspect, the invention relates to a fluorescent whitening agent, which comprises a mixture of compounds of the formulae (1d)
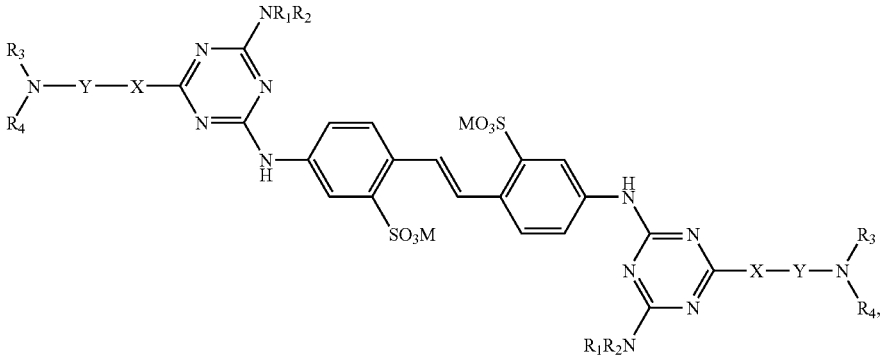
(1e)
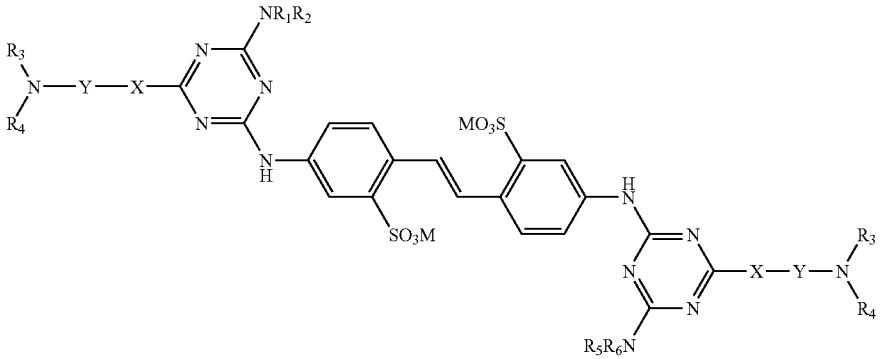
and
(1f)
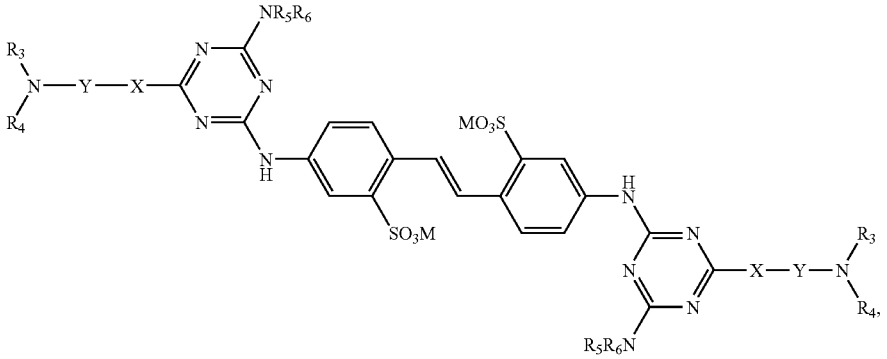

in which

X, Y, $R_1$, $R_2$, $R_3$, $R_4$, $R_5$, $R_6$ and M are as previously defined and, more especially, mixtures of compounds (1d), (1e) and (1f), in which Y is a straight chain $C_2$-$C_6$alkylene or branched $C_3$-$C_6$alkylene residue which may be interrupted by 1 or 2 oxygen atoms, $R_1$, $R_2$, $R_5$ and $R_6$ each independently of each other, represent hydrogen, $C_1$-$C_4$alkyl, $C_2$-$C_4$hydroxyalkyl, phenyl, which is unsubstituted or substituted by methoxy, ethoxy or —$SO_2NH_2$ or $R_1$ and $R_2$, and/or $R_5$ and $R_6$, together with the nitrogen atom to which they are attached, complete a morpholino ring, $R_3$ and $R_4$ both represent $C_1$-$C_4$alkyl, $C_2$-$C_4$hydroxyalkyl or, together with the nitrogen atom to which they are attached, complete a morpholino ring, M represents hydrogen, lithium, potassium or sodium and X is as defined previously.

Most preferred mixtures of compounds (1d)-(1f) are those in which

X represents —O— or —NH—,

Y represents a straight chain $C_2$-$C_4$alkylene or branched $C_3$-$C_4$alkylene residue $R_1$ and $R_5$ both represent hydrogen, $C_1$-$C_4$alkyl, $C_2$-$C_4$hydroxyalkyl or phenyl, $R_2$ and $R_6$ both represent hydrogen or $C_2$-$C_4$hydroxyalkyl, $R_3$ and $R_4$ both represent $C_1$-$C_4$alkyl, $C_2$-$C_4$hydroxyalkyl or, together with the nitrogen atom to which they are attached, complete a morpholino ring and M represents hydrogen or sodium.

In a second preferred aspect, the invention relates to a fluorescent whitening agent, which comprises a mixture of compounds of the formulae (1d)

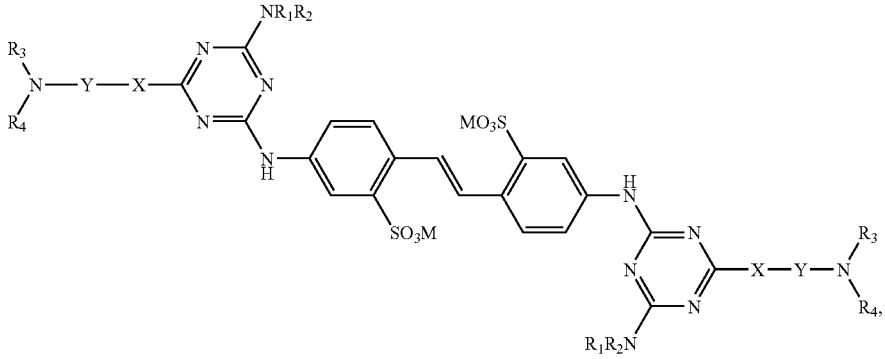

(1g)

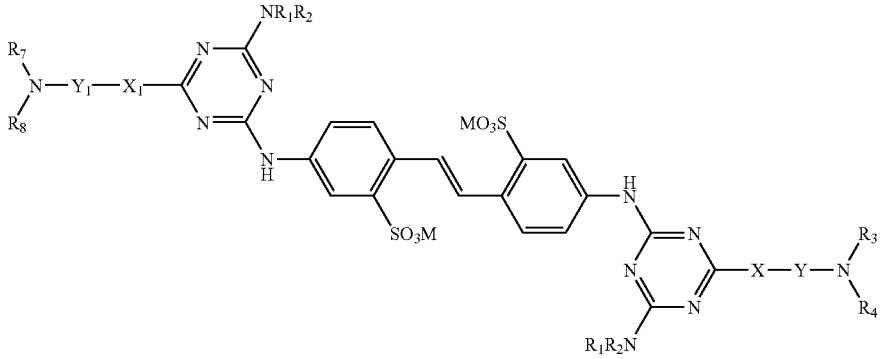

and (1h)

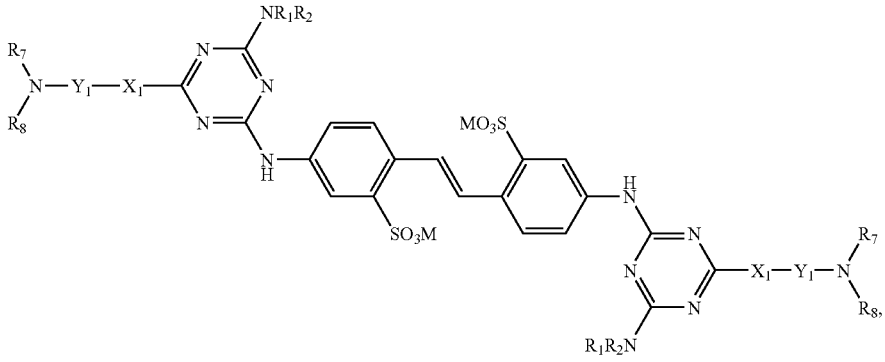

in which

X, $X_1$, Y, $Y_1$, $R_1$, $R_2$, $R_3$, $R_4$, $R_7$, $R_8$ and M are as defined previously, and, more especially, mixtures of compounds (1d), (1g) and (1h) in which X and $X_1$ both represent —NH—, Y and $Y_1$ each, independently of each other, represent a straight chain $C_2$-$C_6$alkylene or branched $C_3$-$C_6$alkylene residue which may be interrupted by 1 or 2 or oxygen atoms, $R_1$ and $R_2$, each independently of each other, represent hydrogen, $C_1$-$C_4$alkyl, $C_2$-$C_4$hydroxyalkyl, phenyl, which is unsubstituted or substituted by methoxy, ethoxy or —$SO_2NH_2$ or $R_1$ and $R_2$, together with the nitrogen atom to which they are attached, complete a morpholino ring, $R_3$, $R_4$, $R_7$ and $R_8$, each independently of each other, represent hydrogen, $C_1$-$C_4$alkyl, $C_2$-$C_4$hydroxyalkyl or $R_3$ and $R_4$ and/or $R_7$ and $R_8$, together with the nitrogen atom to which they are attached, complete a morpholino ring and M represents hydrogen, lithium, potassium or sodium.

Most preferred mixtures of compounds (1d), (1g) and (1h) are those in which

X and $X_1$ both represent —NH—,

Y and $Y_1$ each, independently of each other, represent a straight chain $C_2$-$C_4$alkylene or branched $C_3$-$C_4$alkylene residue, $R_1$ represents hydrogen, $C_1$-$C_4$alkyl, $C_2$-$C_4$hydroxyalkyl or phenyl, $R_2$ represents hydrogen or $C_2$-$C_4$hydroxyalkyl or $R_1$ and $R_2$, together with the nitrogen atom to which they are attached, complete a morpholino ring, $R_3$, $R_4$, $R_7$ and $R_8$, each independently of each other, represent hydrogen, $C_1$-$C_4$alkyl, $C_2$-$C_4$hydroxyalkyl or $R_3$ and $R_4$ and/or $R_7$ and $R_8$, together with the nitrogen atom to which they are attached, complete a morpholino ring and M represents hydrogen or sodium.

In a third aspect, the present invention provides novel amphoteric fluorescent whitening agents of the formula in which $X_1$ Y, $Y_1$, $R_1$, $R_2$, $R_3$, $R_4$, $R_5$, $R_6$, $R_7$, $R_8$ and M are as defined previously, whilst those compounds of formula (2) are preferred, in which $X_1$ represents oxygen, Y and $Y_1$ each, independently of each other, represent a straight chain $C_2$-$C_6$alkylene or branched $C_3$-$C_6$alkylene residue which may be interrupted by 1 or 2 oxygen atoms, $R_1$, $R_2$, $R_5$ and $R_6$ each independently of each other, represent hydrogen, $C_1$-$C_4$alkyl, $C_2$-$C_4$hydroxyalkyl, phenyl, which is unsubstituted or substituted by methoxy, ethoxy or —$SO_2NH_2$ or $R_1$ and $R_2$ and/or $R_5$ and $R_6$, together with the nitrogen atom to which they are attached, complete a morpholino ring, $R_3$, $R_4$, $R_7$ and $R_8$, each independently of each other, represent hydrogen, $C_1$-$C_4$alkyl, $C_2$-$C_4$hydroxyalkyl or $R_3$ and $R_4$ and/or $R_7$ and $R_8$, together with the nitrogen atom to which they are attached, complete a morpholino ring and M represents hydrogen, lithium, potassium or sodium.

Most preferred compounds of formula (2) are those in which $X_1$ represents oxygen, Y and $Y_1$ both represent a straight chain $C_2$-$C_4$alkylene or branched $C_3$-$C_4$alkylene residue, $R_1$ and $R_5$ are each identical and represent hydrogen, $C_1$-$C_4$alkyl, $C_2$-$C_4$hydroxyalkyl or phenyl, $R_2$ and $R_6$ are each identical and represent hydrogen, $C_1$-$C_4$alkyl, $C_2$-$C_4$hydroxyalkyl or $R_1$ and $R_2$ and $R_5$ and $R_6$, together with the nitrogen atom to which they are attached, complete a morpholino ring, $R_3$, $R_4$, $R_7$ and $R_8$ are all identical and represent hydrogen or $C_1$-$C_4$alkyl and M represents hydrogen or sodium, especially hydrogen.

In a fourth aspect, the invention relates to a fluorescent whitening agent, which is a compound of the formula (2)

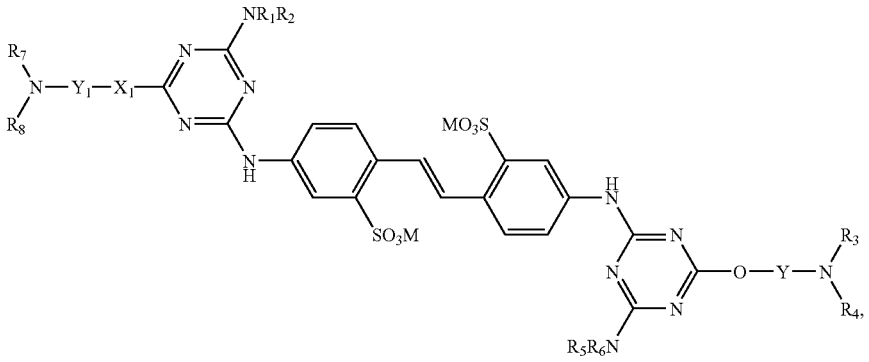

(3)

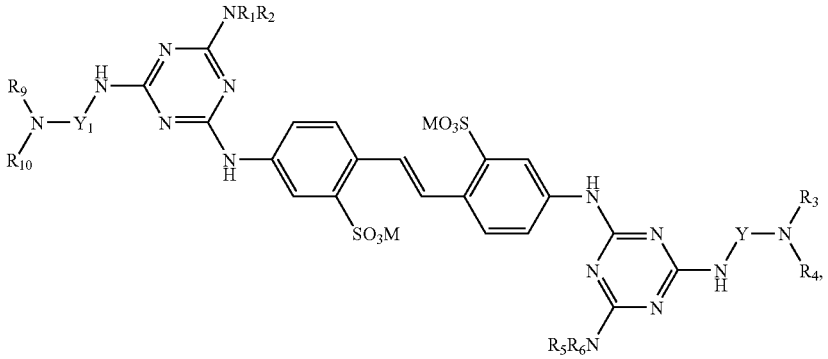

in which $R_9$ and $R_{10}$, each independently of each other, represent hydrogen or $C_2$-$C_4$hydroxyalkyl and Y, $Y_1$, $R_1$, $R_2$, $R_3$, $R_4$, $R_5$, $R_6$, and M are as defined previously, with the proviso that when Y and $Y_1$ both represent —$CH_2CH_2CH_2$—, $R_1$ and $R_5$ are both phenyl and $R_2$ and $R_6$ hydrogen, $R_3$, $R_4$, $R_9$ and $R_{10}$ are not all —$CH_2CH_2OH$, whereby, preferred compounds of formula (3) are those in which Y and $Y_1$ each, independently of each other, represent a straight chain $C_2$-$C_6$alkylene or branched $C_3$-$C_6$alkylene residue which may be interrupted by 1 or 2 oxygen atoms or one nitrogen atom or represent a cyclohexyl moiety, $R_1$, $R_2$, $R_5$ and $R_6$ each independently of each other, represent hydrogen, $C_1$-$C_8$alkyl, $C_2$-$C_4$hydroxyalkyl, phenyl, which is unsubstituted or substituted by methoxy, ethoxy or —$SO_2NH_2$ or $R_1$ and $R_2$ and/or $R_5$ and $R_6$, together with the nitrogen atom to which they are attached, complete a morpholino ring, $R_3$, and $R_4$ each independently of each other, represent hydrogen, $C_1$-$C_4$alkyl, $C_2$-$C_4$hydroxyalkyl or $R_3$ and $R_4$, together with the nitrogen atom to which they are attached, complete a morpholino ring and M represents hydrogen, lithium, potassium or sodium.

Most preferred compounds of formula (3) are those in which,

Y and $Y_1$ both represent a straight chain $C_2$-$C_6$alkylene, which may be interrupted by 1 or 2 oxygen atoms or one nitrogen atom, or represent a cyclohexyl moiety, $R_1$ and $R_5$ are each identical and represent hydrogen, $C_1$-$C_8$alkyl, $C_2$-$C_4$hydroxyalkyl, ethoxyphenyl or phenyl, $R_2$ and $R_6$ are each identical and represent hydrogen, $C_1$-$C_4$alkyl, $C_2$-$C_4$hydroxyalkyl or each $R_1$ and $R_2$ and $R_5$ and $R_6$, together with the nitrogen atom to which they are attached, complete a morpholino ring, $R_3$ and $R_9$ are identical and each represents hydrogen or hydroxyethyl, $R_4$ and $R_{10}$ are identical and each represents hydrogen or hydroxyethyl and M represents hydrogen or sodium, especially hydrogen.

Within the scope of the definitions of the substituents, $C_1$-$C_8$alkyl groups are, for example, methyl, ethyl, n-propyl, isopropyl, n-butyl, sec-butyl, isobutyl or t-butyl, n-pentyl, ethyl propyl, dimethyl propyl, methyl butyl, n-hexyl, dimethyl butyl, methyl pentyl, ethyl butyl, n-heptyl, methyl hexyl, dimethyl pentyl, ethyl pentyl, trimethyl butyl, n-octyl, methyl heptyl, dimethyl or ethyl hexyl or a trimethyl pentyl, whilst $C_1$-$C_4$alkoxy groups are, for example, methoxy, ethoxy, n-propoxy, isopropoxy, n-, sec-, iso- or t-butoxy.

A $C_2$-$C_8$alkylene chain, in the definitions of Y and $Y_1$, may, for example be an ethylene, n-propylene, methyl ethylene, 1- or 2-methylpropylene, n-butylene, ethylethylene, n-pentylene, ethyl propylene, dimethyl propylene, methyl butylene, n-hexylene, dimethyl butylene, methyl pentylene, ethyl butylene, n-heptylene, methyl hexylene, dimethyl pentylene, ethyl pentylene, trimethyl butylene, n-octylene, methyl heptylene, dimethyl or ethyl hexylene or a trimethyl pentylene chain. Where the $C_2$-$C_8$alkylene chain is interrupted by heteroatoms, these may be sulphur or, especially, oxygen, whilst $C_2$-$C_4$ hydroxyalkyl may be hydroxyethyl, hydroxy-n- or isopropyl or hydroxybutyl.

Further, within the scope of the definitions, halogen is iodine, bromine, fluorine or, especially, chlorine, whilst sulphonamido may be —$SO_2NHC_1$-$C_4$alkyl, —$SO_2N(C_1$-$C_4$alkyl$)_2$ or, especially, —$SO_2NH_2$.

Where M represents an alkaline or alkaline earth metal, this may be lithium, potassium, sodium, calcium or magnesium, whilst alkyl ammonium may be ammonium which is mono-, di-, tri- or tetra substituted by $C_1$-$C_4$alkyl or $C_2$-$C_4$hydroxyalkyl or a mixture thereof.

Preferably, M represents hydrogen or sodium.

The mixture of compounds of formulae (1a), (1b) and (1c) of the invention may be prepared by reacting, under known reaction conditions, cyanuric chloride, successively, in any desired sequence, with each of 4,4'-diaminostilbene-2,2'-disulphonic acid, amino compounds of formulae $R_1R_2NH$ and $R_5R_6NH$ or mixtures thereof and compounds of formulae $R_3R_4NYXH$ and $R_7R_8NY_1X_1H$ or mixtures thereof, whereby X, $X_1$, Y, $Y_1$, $R_1$, $R_2$, $R_3$, $R_4$, $R_5$, $R_6$, $R_7$ and $R_8$ are as previously defined.

Depending on the amounts and proportions of the amines $R_1R_2NH$ and $R_5R_6NH$ and of the compounds of formulae $R_3R_4NYXH$ and $R_7R_8NY_1X_1H$ and whether they are added sequentially or simultaneously as a mixture, the proportions of the compounds (1a), (1b) and (1c) can be varied considerably. Thus, the present invention relates to a fluorescent whitening agent which comprises a mixture of the compounds (1a), (1b) and (1c) wherein each of the components are present in a molar ratio of between 5 and 80%, preferably they are present in the approximate molar ratios of 5-45% of the compound of formula (1a), 15-60% of the compound of formula (1b) and 5-45% of the compound of formula (1c). More preferably, the compounds (1a), (1b) and (1c) are present in the approximate molar ratios of 20-50% of the compound of formula (1a), 25-50% of the compound of formula (1b) and 5-35% of the compound of formula (1c). Naturally, such mixtures may also be obtained by mechanical mixing of the individually prepared components.

Similarly, the compound of formula (2) may be prepared by reacting, under known reaction conditions, cyanuric chloride, successively, in any desired sequence, with each of 4,4'-diaminostilbene-2,2'-disulphonic acid, an amino compound of formula $R_1R_2NH$, an amino compound of formula $R_5R_6NH$, a hydroxy compound of formula $R_3R_4NYOH$ and a compound of formula $R_7R_8NY_1X_1H$, $X_1$ Y, $Y_1$, $R_1$, $R_2$, $R_3$, $R_4$, $R_5$, $R_6$, $R_7$ and $R_8$ being as previously defined.

In an analogous manner, the compound of formula (3) may be by reacting, under known reaction conditions, cyanuric chloride, successively, in any desired sequence, with each of 4,4'-diaminostilbene-2,2'-disulphonic acid, an amino compound of formula $R_1R_2NH$, an amino compound of formula $R_5R_6NH$, an amino compound of formula $R_3R_4NYNH_2$ and a compound of formula $R_9R_{10}NY_1NH_2$, Y, $Y_1$, $R_1$, $R_2$, $R_3$, $R_4$, $R_5$, $R_6$, $R_9$ and $R_{10}$ being as previously defined.

In certain cases, it may be advantageous to isolate the intermediate dichlorotriazinylamino derivatives of 4,4'-diaminostilbene-2,2'-disulphonic acid, either as pure asymmetric compounds or as their mixtures, which are subsequently reacted further to yield either mixtures of compounds of formulae (1a), (1b) and (1c), compounds of formula (2) or compounds of formula (3). Since a number of these intermediate dichloro derivatives are novel, a further aspect of the invention is a compound of formula (4a)

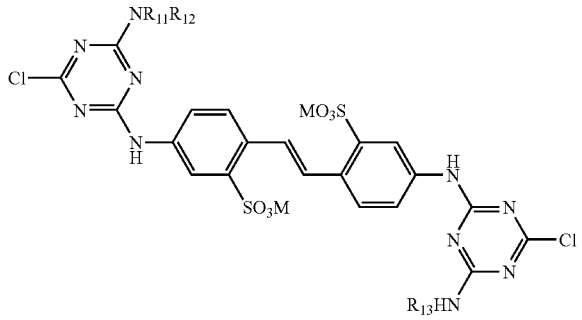

or a mixture comprising compounds of the formulae (4a)

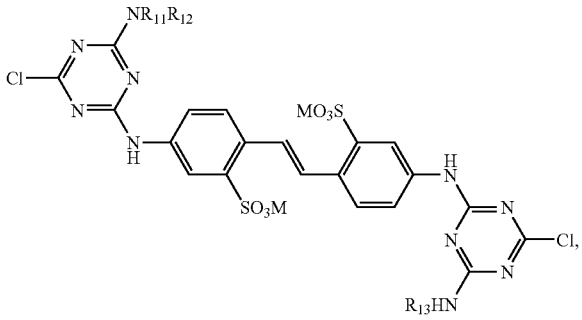

-continued (4b)

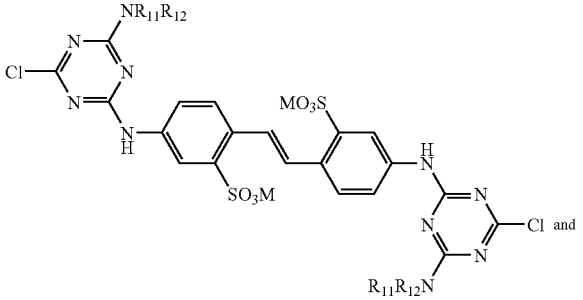

(4c)

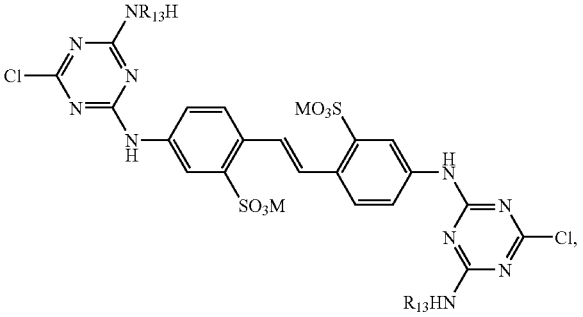

in which $R_{11}$ and $R_{12}$, each independently of each other, represent hydrogen, $C_1$-$C_4$alkyl, $C_2$-$C_4$hydroxyalkyl, $C_1$-$C_4$alkoxy$C_1$-$C_4$alkyl or, together with the nitrogen atom to which they are attached, complete a morpholino-, piperidino- or pyrrolidino-ring, $R_{13}$ represents phenyl, which is unsubstituted or substituted by halogen, $C_1$-$C_4$alkoxy, $C_1$-$C_4$alkyl or sulphonamido and M represents hydrogen, an alkaline or alkaline earth metal, ammonium or alkyl ammonium.

Preferably, $R_{11}$ and $R_{12}$, each independently of each other, represent hydrogen, $C_1$-$C_4$alkyl, $C_2$-$C_4$hydroxyalkyl, especially, both representing $C_1$-$C_3$hyroxyalkyl or, together with the nitrogen atom to which they are attached, complete a morpholino-ring, whilst $R_{13}$ represents phenyl, which is unsubstituted or substituted by methoxy, ethoxy or —$SO_2NH_2$, especially, unsubstituted, sulphonamido- or ethoxy-substituted phenyl and M represents hydrogen, lithium, potassium or sodium, especially, hydrogen or sodium.

In analogy to the previously described processes, compounds of formula (4a) or a mixture of compounds of formulae (4a), (4b) and (4c) may be prepared by reacting, under known reaction conditions, cyanuric chloride, successively, in any desired sequence, with each of 4,4'-diaminostilbene-2,2'-disulphonic acid, an amino compound of formula $R_{11}R_{12}$ NH and an amino compound of formula $R_{13}NH_2$ or with a mixture of amino compounds $R_{11}R_{12}NH$ and $R_{13}NH_2$, $R_{11}$, $R_{12}$ and $R_{13}$ being as previously defined.

As previously mentioned, intermediate compounds of formula (4a) are useful for the preparation of those compounds of formula (2), wherein, $R_1$ and $R_2$ each independently of each other, represent hydrogen, $C_1$-$C_4$alkyl, $C_2$-$C_4$hydroxyalkyl, $C_1$-$C_4$alkoxy$C_1$-$C_4$alkyl or, together with the nitrogen atom to which they are attached, complete a morpholino-, piperidino- or pyrrolidino-ring, $R_5$ represents phenyl, which is unsubstituted or substituted by halogen, $C_1$-$C_4$alkoxy, $C_1$-$C_4$alkyl or sulphonamido, $R_6$ represents hydrogen and $X_1$, Y, $Y_1$, $R_3$, $R_4$, $R_7$, $R_8$ and M are as defined previously and also are useful for the preparation of those compounds of formula (3), in which, in formula (3), $R_1$ and $R_2$ each independently of each other, represent hydrogen, $C_1$-$C_4$alkyl, $C_2$-$C_4$hydroxyalkyl, $C_1$-$C_4$alkoxy$C_1$-$C_4$alkyl or, together with the nitrogen atom to which they are attached, complete a morpholino-, piperidino- or pyrrolidino-ring, $R_5$ represents phenyl, which is unsubstituted or substituted by halogen, $C_1$-$C_4$alkoxy, $C_1$-$C_4$alkyl or sulphonamido, $R_5$ represents hydrogen and Y, $Y_1$, $R_3$, $R_4$, $R_9$, $R_{10}$, and M are as previously defined.

Furthermore, the mixtures of compounds of formulae (4a), (4b) and (4c) are useful for the preparation of those mixtures of compounds of formulae (1a), (1b) and (1c), in which, in formulae (1a), (1b) and (1c), $R_1$ and $R_2$ each independently of each other, represent hydrogen, $C_1$-$C_4$alkyl, $C_2$-$C_4$hydroxyalkyl, $C_1$-$C_4$alkoxy$C_1$-$C_4$alkyl or, together with the nitrogen atom to which they are attached, complete a morpholino-, piperidino- or pyrrolidino-ring, $R_5$ represents phenyl, which is unsubstituted or substituted by halogen, $C_1$-$C_4$alkoxy, $C_1$-$C_4$alkyl or sulphonamido, $R_6$ represents hydrogen and X, $X_1$, Y, $Y_1$, $R_3$, $R_4$, $R_7$, $R_8$ and M are as defined previously.

One further aspect of the preparation of certain compounds and compound mixtures described above is also of importance. In the case in which X or $X_1$ represents oxygen and at least one of the substituents $R_3$, $R_4$, $R_7$ and $R_8$ represents hydrogen, it may be necessary to introduce a protective group such as —COAlkyl onto the nitrogen atom in order to ensure reaction occurring in the desired direction, the protective group being subsequently removed by conventional methods.

A further synthetic variation, which may be advantageous for the preparation of asymmetric derivatives, is to replace the 4,4'-diaminostilbene-2,2'-disulphonic acid by 4-amino-4'-nitrostilbene-2,2'-disulphonic acid and, after carrying out the desired condensation reactions, reducing the nitro group to an amino group, whereby further desired condensation reactions may subsequently be performed.

All starting materials are known compounds, which are readily available or may be prepared by known methods.

A further aspect of the invention is a composition for whitening of paper, which contains water, a fluorescent whitening agent which comprises a mixture of compounds of the formulae (1a), (1b) and (1c), a fluorescent whitening agent of formula (2) or a fluorescent whitening agent of the formula (5)

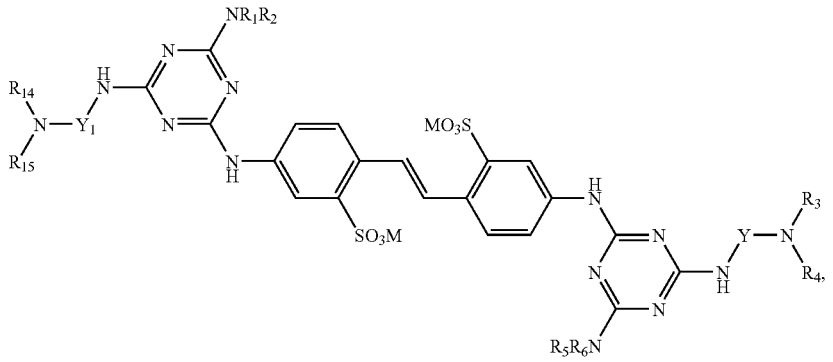

in which $R_{14}$ and $R_{15}$, each independently of each other, represent hydrogen, $C_1$-$C_4$alkyl or $C_2$-$C_4$hydroxyalkyl and Y, $Y_1$, $R_1$, $R_2$, $R_3$, $R_4$, $R_5$, $R_6$, and M are as defined previously, and, optionally, auxiliaries.

Such compositions may comprise not only mixture of compounds of the formulae (1a), (1b) and (1c), compounds of formula (2) and compounds of formula (5) alone, but also mixtures of the individual component mixtures and components with one another More specifically, such brightener compositions contain water and, in each case based on the weight of the formulation, from 3 to 25% by weight, preferably from 5 to 15% by weight of the above defined fluorescent whitening agent mixture and also 0 to 60%, preferably 5 to 50% by weight, of auxiliaries.

Suitable auxiliaries include, for example, anionic or nonionic dispersants from the class of ethylene oxide adducts with fatty alcohols, higher fatty acids or alkyl phenols or ethylenediamine ethylene oxide-propylene oxide adducts, copolymers of N-vinylpyrrolidone with 3-vinylpropionic acid, polyethylene glycols, water retention aids, such as ethylene glycol, glycerol or sorbitol, or biocides.

Since most of the mixtures of compounds of formulae (1a), (1b) and (1c), the compounds of formula (2) and the compounds of formula (5) are excellent fluorescent whitening agents for substrates such as paper, the present invention further provides a method for the fluorescent whitening of paper comprising contacting the substrate with a fluorescent whitening agent which comprises a mixture of compounds of formulae (1a), (1b) and (1c), a compound of formula (2) and/or a compound of formula (5).

When used for the fluorescent whitening of paper, the mixture of compounds of formulae (1a), (1b) and (1c), the compound of formula (2) and/or the compound of formula (5), according to the present invention, may be applied to the paper substrate in the pulp mass, in the form of a paper coating composition, or directly in the size press or metering press.

In one preferred aspect, the present invention provides a method for the fluorescent whitening of a paper surface, comprising contacting the paper surface with a coating composition comprising a white pigment; a binder dispersion; optionally a water-soluble co-binder; and sufficient of a fluorescent whitening agent, according to the present invention, to ensure that the treated paper contains 0.01 to 1% by weight, based on the white pigment, of a fluorescent whitening agent of the invention.

As the white pigment component of the paper coating composition used according to the method of the present invention, there are preferred inorganic pigments, e.g., aluminium or magnesium silicates, such as China clay and kaolin and, further, barium sulfate, satin white, titanium dioxide, calcium carbonate (chalk) or talcum; as well as white organic pigments.

The paper coating compositions used according to the method of the present invention may contain, as binder, inter alia, plastics dispersions based on copolymers of butadiene/styrene, acrylonitrile/butadiene/styrene, acrylic acid esters, acrylic acid esters/styrene/acrylonitrile, ethylene/vinyl chloride and ethylene/vinyl acetate; or homopolymers, such as polyvinyl chloride, polyvinylidene chloride, polyethylene and polyvinyl acetate or polyurethanes. A preferred binder consists of styrene/butyl acrylate or styrene/butadiene/acrylic acid copolymers or styrene/butadiene rubbers. Other polymer latices are described, for example, in U.S. Patent Specifications 3,265,654, 3,657,174, 3,547,899 and 3,240,740.

The optional water-soluble protective colloid may be, e.g., soya protein, casein, carboxymethylcellulose, natural or modified starch, chitosan or a derivative thereof or, especially, polyvinyl alcohol. The preferred polyvinyl alcohol protective colloid component may have a wide range of saponification levels and molecular weights; e.g. a saponification level ranging from 40 to 100; and an average molecular weight ranging from 10,000 to 100,000.

Recipes for coating compositions for paper are described, for example, in J. P. Casey "Pulp and Paper"; Chemistry and Chemical Technology, 2nd edition, Volume III, pages 1684-1649 and in "Pulp and Paper Manufacture", 2nd and 5th edition, Volume II, page 497 (McGraw-Hill).

The paper coating compositions used according to the method of the present invention preferably contain 10 to 70% by weight of a white pigment. The binder is preferably used in an amount, which is sufficient to make the dry content of polymeric compound up to 1 to 30% by weight, preferably 5 to 25% by weight, of the white pigment. The amount of fluorescent brightener preparation used according to the invention is calculated so that the fluorescent brightener is preferably present in amounts of 0.01 to 1% by weight, more preferably 0.05 to 1% by weight, and especially 0.05 to 0.6% by weight, based on the white pigment.

The paper coating composition used in the method according to the invention can be prepared by mixing the components in any desired sequence at temperatures from 10 to 100° C., preferably 20 to 80° C. The components here also include the customary auxiliaries, which can be added to regulate the rheological properties, such as viscosity or water retention capacity, of the coating compositions. Such auxiliaries are, for example, natural binders, such as starch, casein, protein or gelatin, cellulose ethers, such as carboxyalkylcellulose or hydroxyalkylcellulose, alginic acid, alginates, polyethylene oxide or polyethylene oxide alkyl ethers, copolymers of ethylene oxide and propylene oxide, polyvinyl alcohol, water-soluble condensation products of formaldehyde with urea or melamine, polyphosphates or polyacrylic acid salts.

The coating composition used according to the method of the present invention is preferably used to produce coated printed or writing paper, or special papers such as ink-jet or photographic papers, or cardboard.

The coating composition used according to the method of the invention can be applied to the substrate by any conventional process, for example with an air blade, a coating blade, a roller, a doctor blade or a rod, or in the size press, after which the coatings are dried at paper surface temperatures in the range from 70 to 200° C., preferably 90 to 130° C., to a residual moisture content of 3-8%, for example with infra-red driers and/or hot-air driers. Comparably high degrees of whiteness are thus achieved even at low drying temperatures.

By the use of the method according to the invention, the coatings obtained are distinguished by optimum distribution of the dispersion fluorescent brightener over the entire surface and by an increase in the level of whiteness thereby achieved, by a high fastness to light and to elevated temperature (e.g. stability for 24 hours at 60-100° C.) and excellent bleed-fastness to water.

In a second preferred aspect, the present invention provides a method for the fluorescent whitening of a paper surface comprising contacting the paper in the size press with an aqueous solution containing a size, optionally an inorganic or organic pigment and 0.1 to 20 g/l of a fluorescent whitening agent of the invention. Preferably, the size is starch, a starch derivative or a synthetic sizing agent, especially a water-soluble copolymer.

In a third preferred aspect, the invention provides a method for the fluorescent whitening of paper during paper formation, whereby the FWA is added directly to the pulp mass. In this case, the FWA may be in the form of a solution, a dispersion or as a powder, whereby the FWA's of the invention are especially valuable in that their effect is not inhibited by the presence of cationic polymers, fixing agents, wet-strengthening agents or de-inking auxiliaries, which are similarly added to the pulp mass prior to paper formation. Examples of such auxiliaries may include dicyandiamide condensation products, polyvinyl amines, polyethylene imines, cationic starches, poly-DADMAC (diallyl dimethyl ammonium chloride), polyamide amines and polyepoxides.

In a final aspect, the invention relates to paper, which has been treated with a fluorescent whitening agent comprising either a mixture of compounds of formulae (1a), (1b) and (1c), a compound of formula (2) or a compound of formula (5).

The compounds of the present invention are particularly advantageous in that they exhibit not only extremely high whitening ability, also in the presence of cationic polymers or residual amounts of anionic FWA's, but, in addition, in many cases highly desirable water solubilities and fastness properties.

The following Examples serve to illustrate the invention without intending to be restrictive in nature; parts and percentages are by weight, unless otherwise stated. Percentage compositions of reaction mixtures are calculated as the areas under the curves of the respective HPLC spectra, observed at 350 nm.

PREPARATIVE EXAMPLES

Example 1

(101)

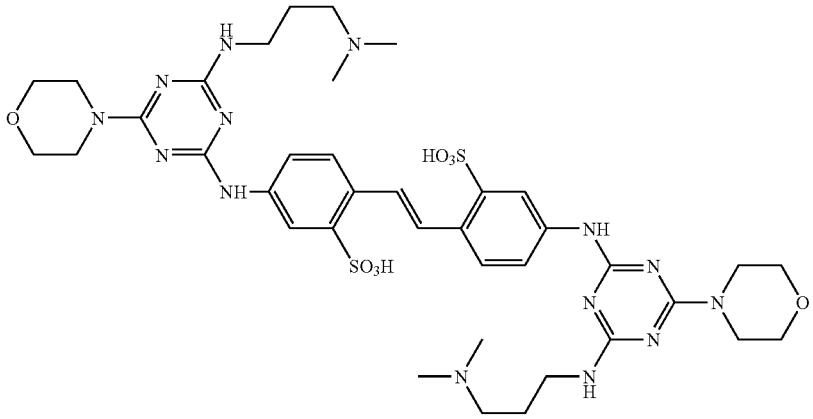

16.7 g of 4,4'-bis [(4-N-morpholino-6-chloro-1,3,5-triazin-2-yl)amino]stilbene-2,2'-disulphonic acid disodium salt are added over 30 minutes with stirring at 25° C. to 50 ml of 3-N,N-dimethylamino-1-propylamine, whereby, during the addition, the temperature rises to 60° C. The temperature is then further increased to 100° C. and the mixture maintained at this temperature for a further 1 hour. Heating is then ceased, the mixture allowed to stand overnight at room temperature, then diluted with 25 ml of water and evaporated under vacuum to approximately 30 g. The resulting residue is dissolved in 50 ml of water and the pH adjusted to 1.0 by addition of 20 ml of concentrated hydrochloric acid. The pH is then raised to approximately 5 and the mixture stirred overnight at room temperature. The precipitated solids are filtered, washed with water and dried under vacuum at 60° C. There are obtained 14.9 g of the compound of formula (101) as pale yellow crystals with an active content of 83%.

The starting material, 4,4'-bis [(4-N-morpholino-6-chloro-1,3,5-triazin-2-yl)amino]stilbene-2,2'-disulphonic acid disodium salt of formula (101a), is prepared as follows:

A solution of 120 g of cyanuric chloride in 930 ml of methyl ethyl ketone is added with stirring over 10 minutes at 5-10° C. to 400 g of ice/water. Then, during 70 minutes at a pH of from 4.5 to 5.0, 1042 g of a 12% solution of 4,4'-diaminostilbene-2,2'-disulphonic acid and sodium carbonate are added such that no excess of 4,4'-diaminostilbene-2,2'-disulphonic acid is present. The mixture is stirred for a further 20 minutes at 5-10° C., after which time a total of 37.9 ml of 20% aqueous sodium carbonate solution is consumed. The mixture is warmed to 15-20° C. and the pH adjusted to 7.0 by addition of 20% aqueous sodium carbonate solution. 28.0 g of morpholine are then added drop wise over 10 minutes, the mixture warmed to 70-75° C. during 60 minutes and stirring continued for 30 minutes at this temperature, the pH being maintained at 7.0-7.5 by addition of a total of 46.9 ml of 50% aqueous sodium hydroxide solution. The temperature is then raised to 90° C. and the methyl ethyl ketone distilled off. The reaction mixture is then slowly cooled to 25° C. over 60 minutes, the precipitated solids filtered, washed with 5% brine and dried under vacuum at 60° C. There are obtained 232.2 g of the compound of formula Example 2

(102)

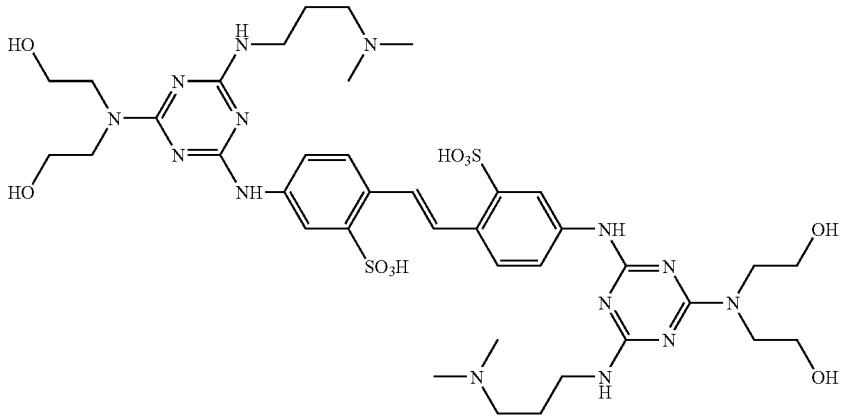

8.9 g of 4,4'-bis [(4-bis-(2-hydroxethyl)amino-6-chloro-1,3,5-triazin-2-yl)amino]stilbene-2,2'-disulphonic acid disodium salt, obtained by an analogous process to that described for compound (101a) in Example 1, are added over 10 minutes with stirring at 25° C. to 25 ml of 3-N,N-dimethylamino-1-propylamine, whereby, during the addition, the temperature rises to 45° C. The temperature is then further increased to 100° C. and the mixture maintained at this temperature for a further 1.75 hours. Heating is then ceased, the mixture allowed to stand overnight at room temperature, then diluted with 25 ml of water and evaporated under vacuum to approximately 18 g. The resulting residue is diluted with 50 ml of water and the pH adjusted to 1.0 by addition of aqueous 17% hydrochloric acid. 90 ml of acetone are then added, resulting in the formation of 2 phases. The aqueous phase is separated off in a separating funnel and the pH is then raised to 8.5 by addition of 4N aqueous sodium hydroxide solution. The precipitated solids are filtered, washed with water and dried under vacuum at 60° C. There are obtained 5.0 g of the compound of formula (102) as yellow crystals.

Example 3

(130)

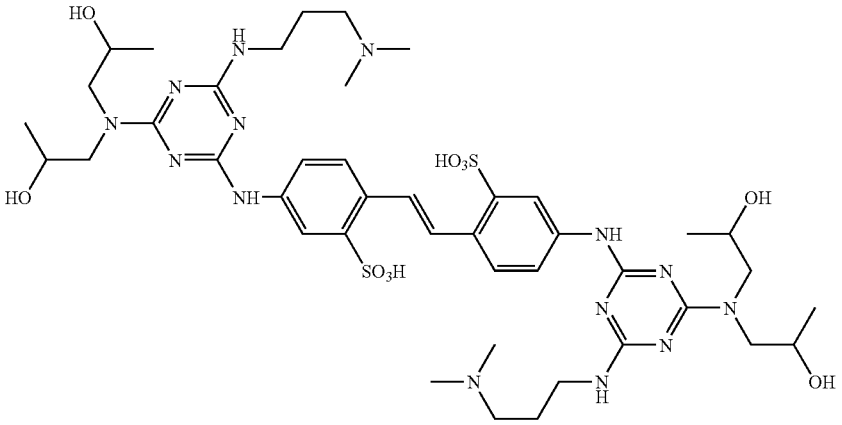

By proceeding essentially as described in Example 2, but replacing the 4,4'-bis [(4-bis(2-hydroxyethyl)amino-6-chloro-1,3,5-triazin-2-yl)amino]stilbene-2,2'-disulphonic acid disodium salt by an equivalent quantity of 4,4'-bis [(4-bis(2-hydroxy-n-propyl)amino-6-chloro-1,3,5-triazin-2-yl)amino]stilbene-2,2'-disulphonic acid disodium salt, obtained by an analogous process to that described for compound (101a) in Example 1, there are obtained 6.4 g of the compound of formula (103) as pale yellow crystals Example 4

(104)

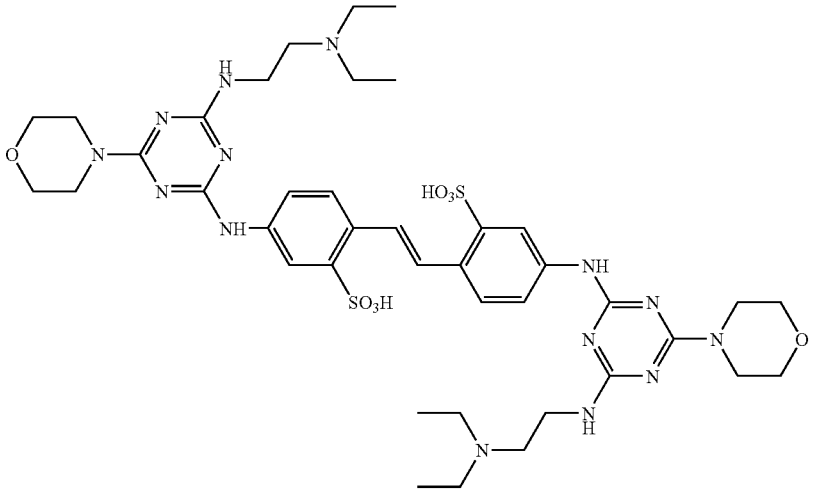

24.3 g of 4,4'-bis [(4-N-morpholino-6-chloro-1,3,5-triazin-2-yl)amino]stilbene-2,2'-disulphonic acid disodium salt (101a) are added over 15 minutes with stirring at 69.6 g of 2-N,N-diethylamino-1-ethylamine. The resulting suspension is then heated to 115° C. and the mixture maintained at this temperature for a further 2 hours. After diluting with 150 ml of water, the pale brown solution is evaporated under vacuum and this procedure repeated twice. Addition of 100 ml of water to the residue results in a beige suspension of pH 11.2. The pH is then adjusted to 12.8 by addition of 5 ml of 50% aqueous sodium hydroxide solution, then lowered to 4 by addition of 35 ml of concentrated hydrochloric acid, the yellow precipitate stirred for 30 minutes, filtered and washed with 1000 ml of water. After drying under vacuum at 70° C., there are obtained 26.7 g of the compound of formula (104) as yellow crystals.

Example 5

(105)

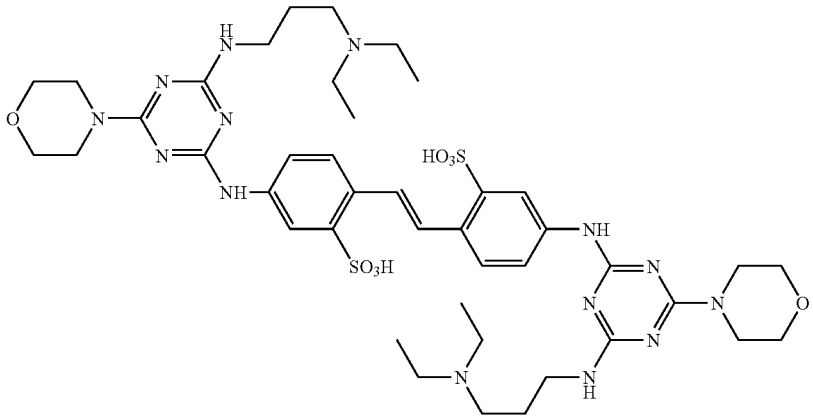

By proceeding essentially as described in Example 4, but replacing the 2-N,N-diethylamino-1-ethylamine by an equivalent quantity of 3-N,N-diethylamino-1-propylamine, there are obtained 27.0 g of the compound of formula (105) as whitish beige crystals.

Example 6

(106)

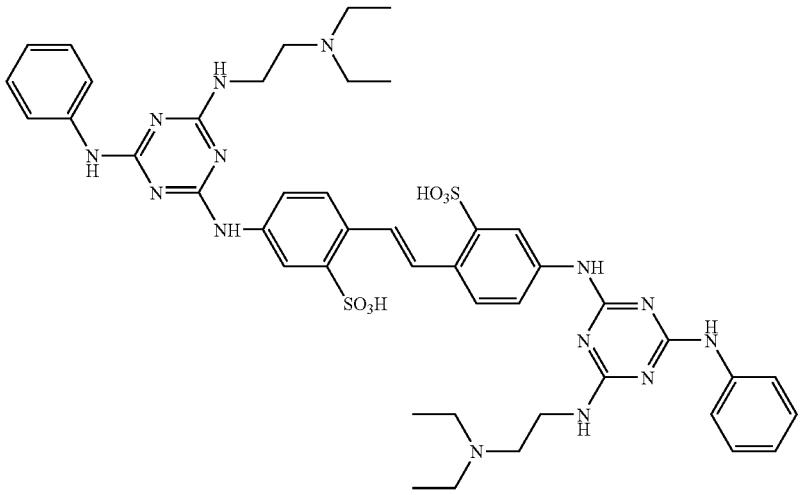

By proceeding essentially as described in Example 4, but replacing the 4,4'-bis [(4-N-morpholino-6-chloro-1,3,5-triazin-2-yl)amino]stilbene-2,2'-disulphonic acid disodium salt by an equivalent quantity of 4,4'-bis [(4-anilino-6-chloro-1,3,5-triazin-2-yl)amino]stilbene-2,2'-disulphonic acid disodium salt, obtained by an analogous process to that described for compound (101a) in Example 1, there are obtained 19.9 g of the compound of formula (106) as beige crystals.

Example 7

(107)

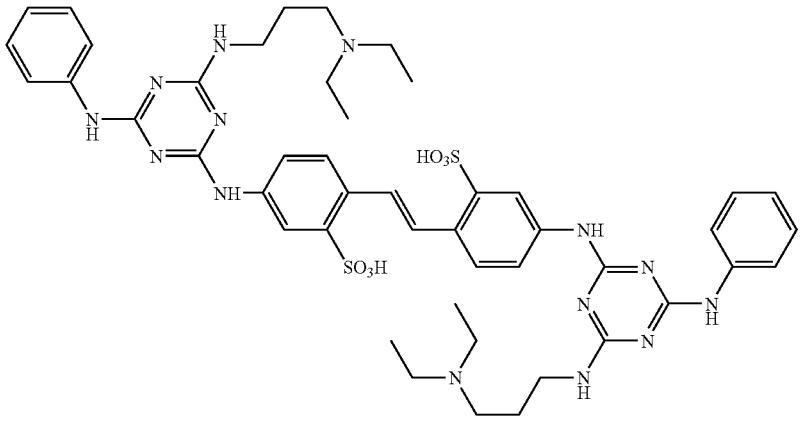

By proceeding essentially as described in Example 4, but replacing the 4,4'-bis [(4-N-morpholino-6-chloro-1,3,5-triazin-2-yl)amino]stilbene-2,2'-disulphonic acid disodium salt by an equivalent quantity of 4,4'-bis [(4-anilino-6-chloro-1,3,5-triazin-2-yl)amino]stilbene-2,2'-disulphonic acid disodium salt and the 2-N,N-diethylamino-1-ethylamine by an equivalent quantity of 3-N,N-diethylamino-1-propylamine, there are obtained 26.6 g of the compound of formula (107) as beige crystals.

Example 8

(108)

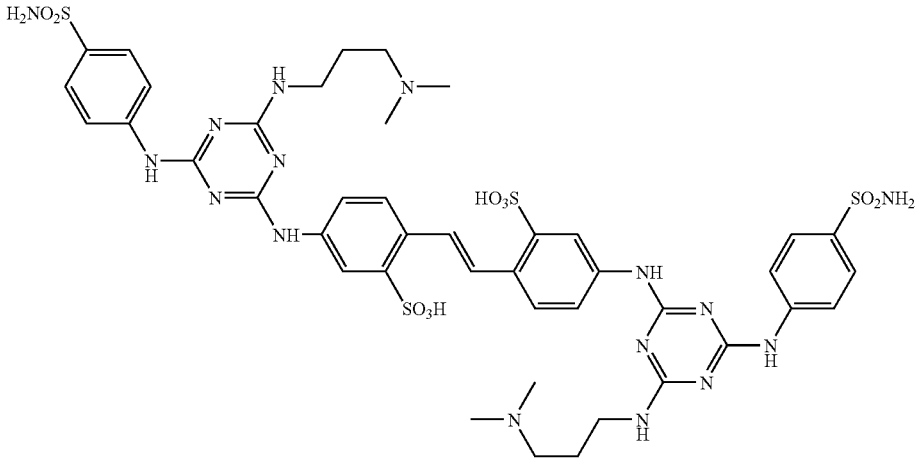

9.5 g of 4,4'-bis{[4-(4-sulphonamidoanilino)-6-chloro-1,3,5-triazin-2-yl]amino}stilbene-2,2'-disulphonic acid disodium salt, obtained by an analogous process to that described for compound (101a) in Example 1, are added over 20 minutes with stirring at 90° C. to 32.0 g of 3-N,N-dimethylamino-1-propylamine. The temperature is then further increased to 115-120° C. and the mixture maintained at this temperature for a further 2 hours. Heating is then ceased, the mixture then diluted with 120 ml of water and evaporated under vacuum. After repeating the latter procedure, the resulting residue is dissolved in 150 ml of water and the pH adjusted to 12-13 by addition of aqueous sodium hydroxide. Subsequently, the pH is adjusted to 6 by addition of concentrated hydrochloric acid and the resulting precipitate filtered, washed with water and dried under vacuum at 70° C. There are obtained 8.4 g of the compound of formula (108) as pale yellow crystals.

Example 9

(109)

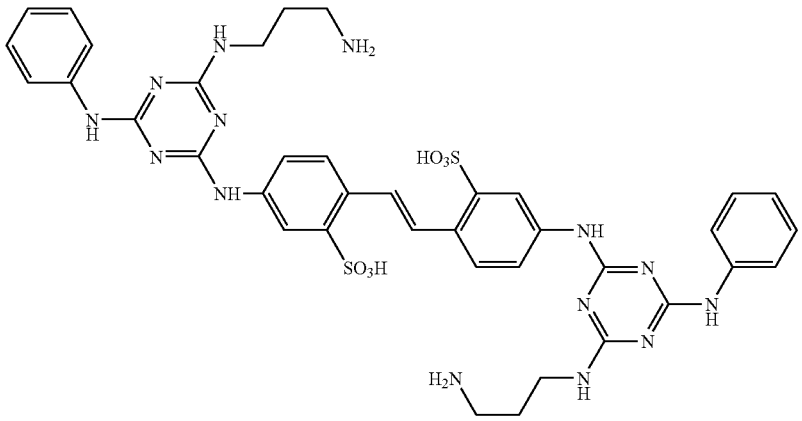

10.0 g of 4,4'-bis [(4-anilino-6-chloro-1,3,5-triazin-2-yl) amino]stilbene-2,2'-disulphonic acid disodium salt are added over 15 minutes with stirring at 30° C. to 30 ml of 1,3-diaminopropane, whereby the temperature rises to 50° C. The yellow suspension is then heated to 80° C. and stirring continued at this temperature for a further 90 minutes. After cooling, the mixture is poured into 300 ml of water and the pH adjusted to 2 by addition of 65 ml of concentrated hydrochloric acid. The aqueous liquors are decanted from the oily residue, which residue is ground with water in a mortar and then stirred for 2 hours at pH 5. The solids are filtered off, washed with 5% brine and dried under vacuum at 70° C. There are obtained 10.1 g of the compound of formula (109) as yellow crystals.

Example 10

(110)

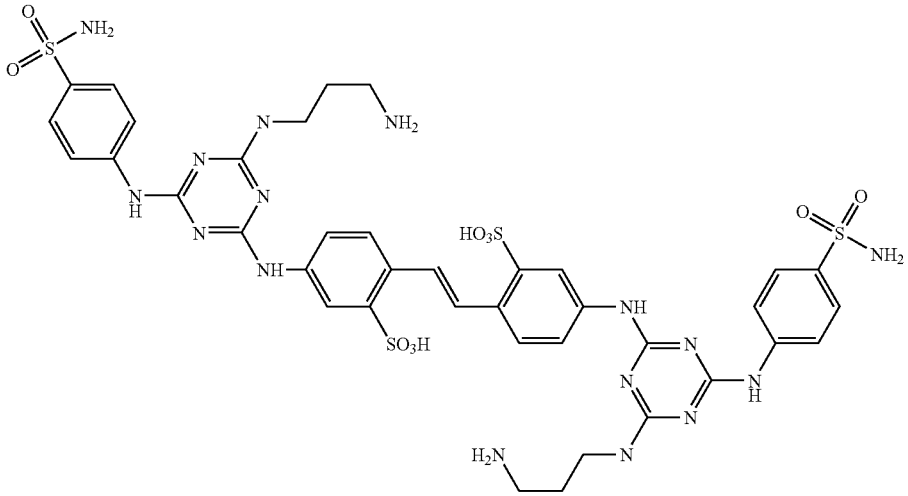

By following the procedure described in example 9, but replacing the 4,4'-bis [(4-anilino-6-chloro-1,3,5-triazin-2-yl) amino]stilbene-2,2'-disulphonic acid disodium salt by an equivalent quantity of 4,4'-bis{[4-(4-sulphonamidoanilino)-6-chloro-1,3,5-triazin-2-yl]amino}stilbene-2,2'-disulphonic acid disodium salt, 12.0 g of the compound of formula (110) are obtained as pale brown crystals.

Example 11

(111)

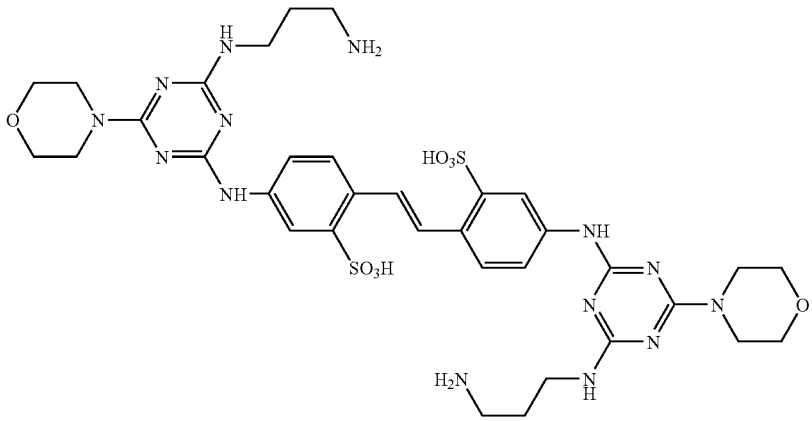

In a manner analogous to that described in Example 9, 8.5 g of 4,4'-bis [(4-N-morpholino-6-chloro-1,3,5-triazin-2-yl) amino]stilbene-2,2'-disulphonic acid disodium salt are reacted with 30 ml of 1,3-diaminopropane to yield 9.1 g of the compound of formula (111) as yellow crystals.

Example 12
A mixture of compounds of formulae
(112a)
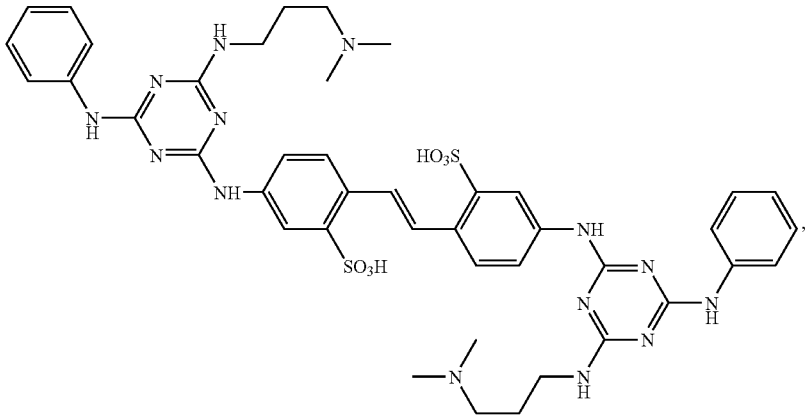
(112b)
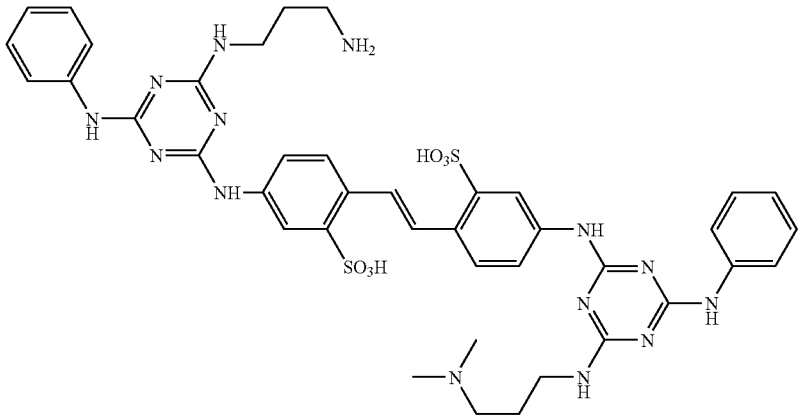
and
(112c)
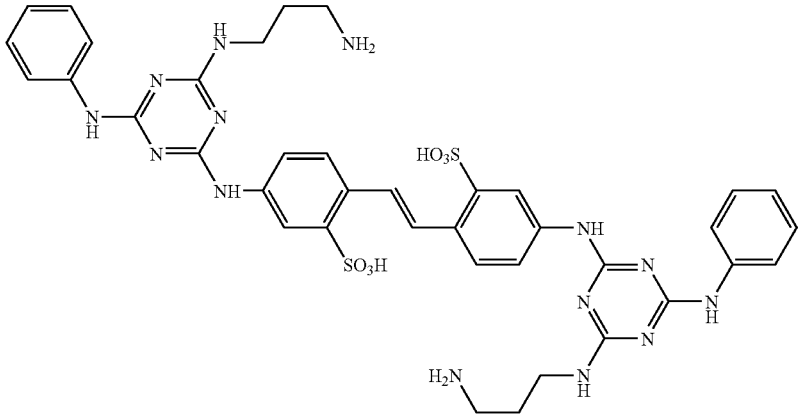

16.46 g of 4,4'-bis [(4-anilino-6-chloro-1,3,5-triazin-2-yl) amino]stilbene-2,2'-disulphonic acid disodium salt are added over 30 minutes with stirring at 50° C. to a mixture of 33.95 g of 3-N,N-dimethylamino-1-propylamine and 12.25 g of 1,3-diaminopropane, wherby the temperature rises to 85° C. The yellowish brown viscous solution is then heated to 90° C. and stirring continued for a further 5 hours at this temperature. After cooling, the mixture is poured into 300 ml of water and the resulting yellow solution of pH 11.4 allowed to stand overnight. The pH is then adjusted to 3 by addition of 85 ml of concentrated hydrochloric acid, the mixture stirred for a further 2 hours and the precipitated solids filtered, washed with 5% brine and dried under vacuum at 70° C. There are obtained 18.2 g of the mixture of compounds of formulae containing 40% (112a), 44% (112b) and 13% (112c) as yellow crystals.

Example 13

A mixture of compounds of formulae (113a)

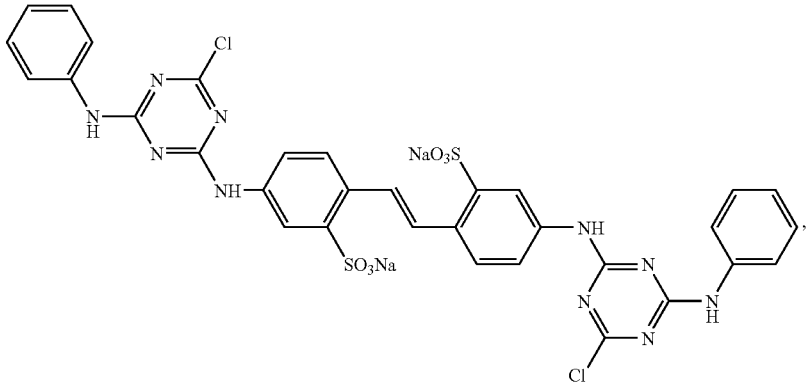

(113b)

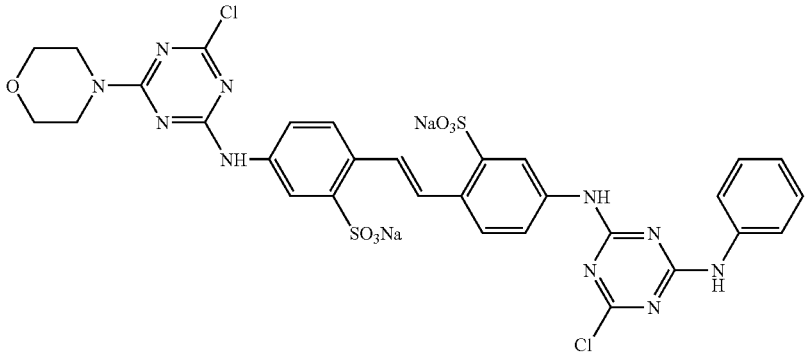

and (101a)

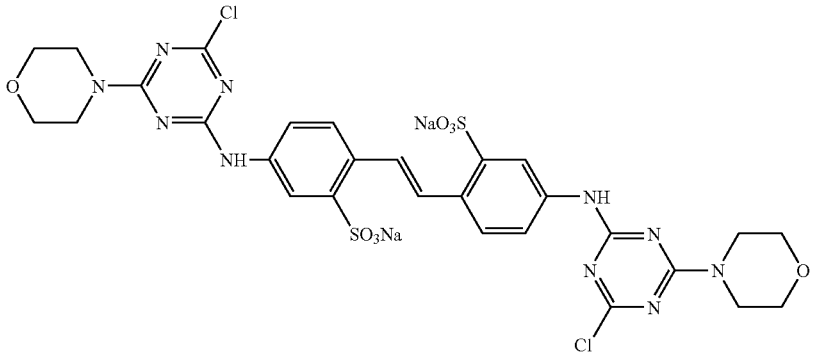

A solution of 120 g of cyanuric chloride in 930 ml of methyl ethyl ketone is added with stirring over 10 minutes at 5-10° C. to 400 g of ice/water. Then, during 70 minutes at a pH of from 4.5 to 5.0, 1093 g of a 12% solution of 4,4'-diaminostilbene-2,2'-disulphonic acid and sodium carbonate are added such that no excess of 4,4'-diaminostilbene-2,2'-disulphonic acid is present. The mixture is stirred for a further 10 minutes at 5-10° C., after which time a total of 21.2 ml of 20% aqueous sodium carbonate solution is consumed. The mixture is warmed to 8-20° C. and the pH adjusted to 7.5 by addition of 50% aqueous sodium hydroxide solution. A mixture of 29.9 g of aniline and 28.0 g of morpholine is then added drop wise over 10 minutes, the mixture warmed to 70° C. during 60 minutes and stirring continued for 90 minutes at this temperature, the methyl ethyl ketone being distilled off. A total of 54.2 ml of 50% aqueous sodium hydroxide solution are required to maintain a pH of 7.5 during this period. The reaction mixture is then cooled to 30° C. over 60 minutes and allowed to stand overnight at room temperature. The supernatant liquid is decanted off, the residue suspended in 750 ml of 5% brine, warmed to 60° C. and then slowly cooled to 30° C. over 60 minutes. The precipitated solids are filtered, washed with 5% brine and dried under vacuum at 70° C. There are obtained 259.1 g of a yellow crystalline product containing 27% of the compound of formula (113a), 46% (113b) and 24% (101a).

Example 14

A mixture of compounds of formulae (113a)

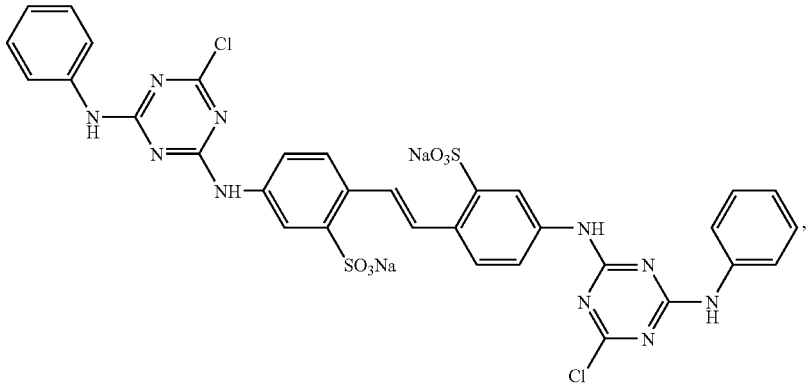

(114b)

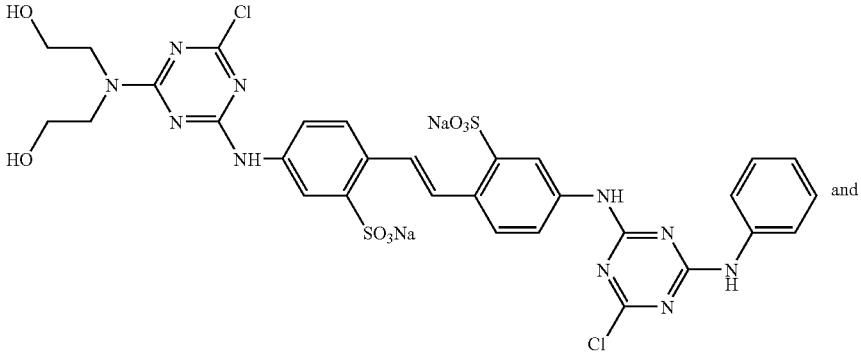

and (114c)

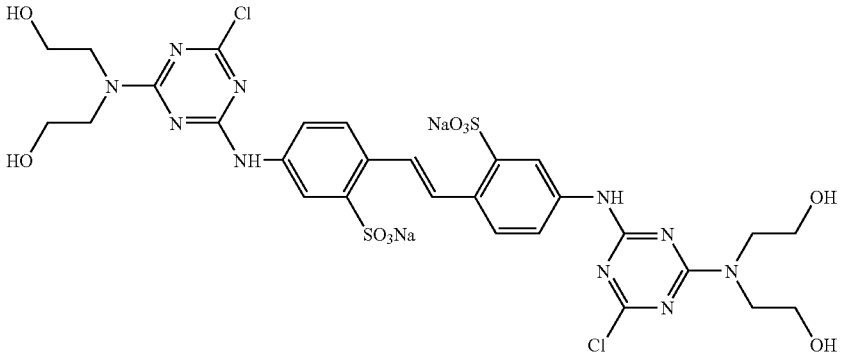

By following the procedure described in Example 13, but replacing the 28.0 g of morpholine by 33.7 g of diethanolamine, there are obtained 287.3 g of a yellow crystalline product containing 24% of the compound of formula (113a), 38% (114b) and 30% (114c).

Example 15

(115)

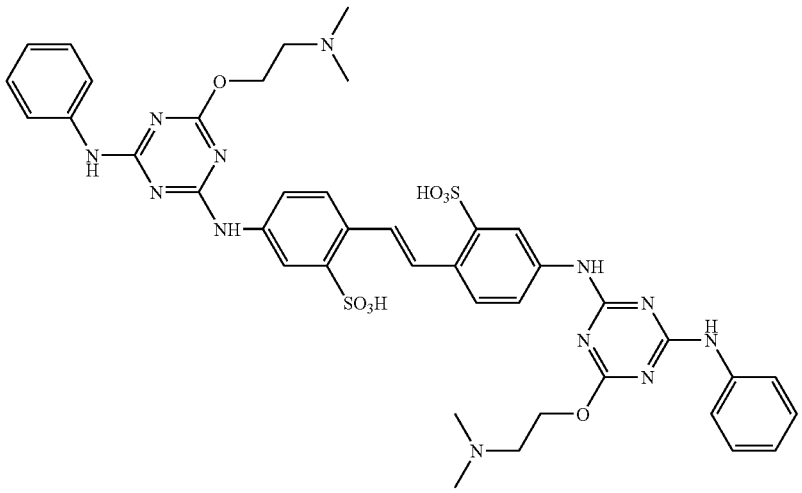

30.0 g of 4,4'-bis [(4-anilino-6-chloro-1,3,5-triazin-2-yl) amino]stilbene-2,2'-disulphonic acid disodium salt are added with stirring over 10 minutes at 80° C. to 100.0 g of 2-N,N-dimethylamino ethanol. The beige suspension is then heated to 120° C. and stirred for a further 1.5 hours at this temperature. After cooling to 100° C., the mixture is diluted with 100 ml of water and evaporated on a rotary evaporator. The residue (56 g) is taken up in 300 ml of water, the pH of the yellowish brown suspension adjusted to 5 by addition of hydrochloric acid and the mixture stirred for a further 1 hour. The precipitated solids are filtered, washed with water and dried under vacuum at 70° C. There are obtained 30.2 g of the compound of formula (115) as whitish beige crystals.

Example 16

A mixture of compounds of formulae (113a)

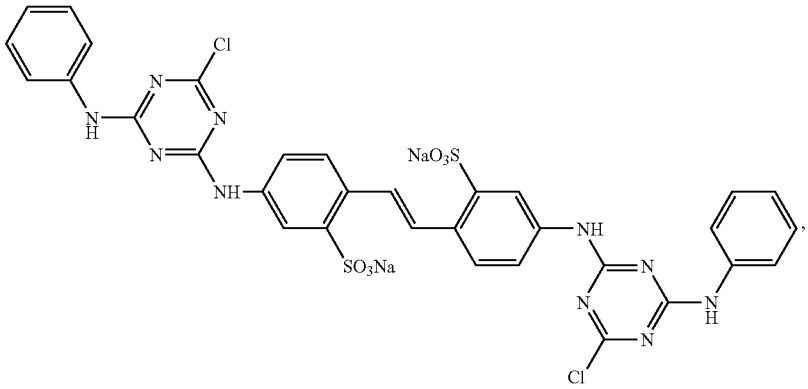

-continued (116b)

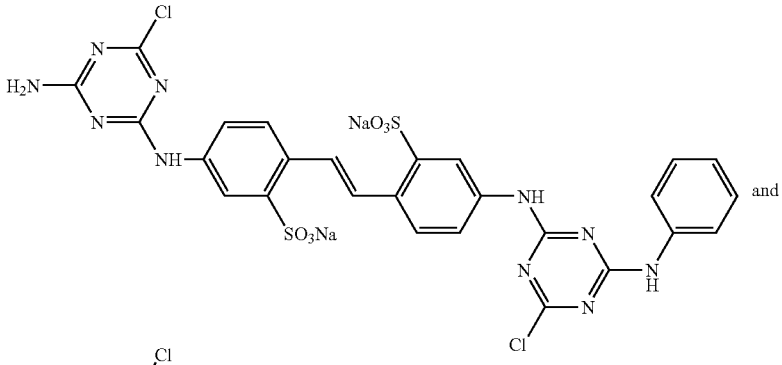

and (116c)

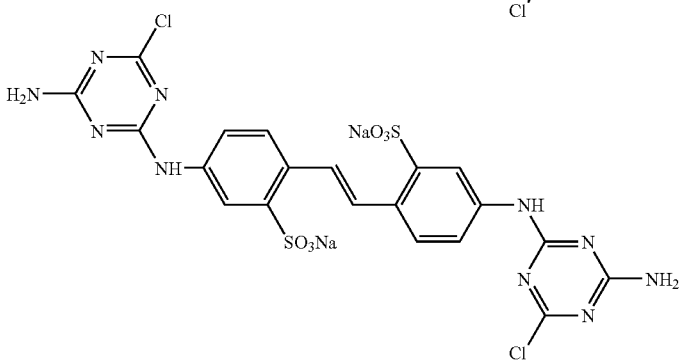

A solution of 120 g of cyanuric chloride in 930 ml of methyl ethyl ketone is added with stirring over 10 minutes at 5-10° C. to 400 g of ice/water. Then, during 70 minutes at a pH of from 4.5 to 5.0, 978 g of a 12% solution of 4,4'-diaminostilbene-2,2'-disulphonic acid and sodium carbonate are added such that no excess of 4,4'-diaminostilbene-2,2'-disulphonic acid is present. The mixture is stirred for a further 10 minutes at 5-10° C., after which time a total of 24.2 ml of 20% aqueous sodium carbonate solution is consumed. The mixture is warmed to 10-20° C. and the pH adjusted to 7.5 by addition of 50% aqueous sodium hydroxide solution. 29.9 g of aniline are then added drop wise over 10 minutes, the mixture warmed to 30° C. and stirring continued for 30 minutes at this temperature. A solution of 17.2 g of ammonium chloride in 50 ml of water is then added drop wise over 15 minutes and the resulting yellow suspension heated to 70° C. After stirring for a further 60 minutes, 100 ml of 25% aqueous ammonia are added, the mixture stirred for 30 minutes and the methyl ethyl ketone is finally distilled off. The resulting mixture is cooled to 30° C., the precipitated solids filtered, washed with a little water, then with 5% brine and dried under vacuum at 70° C. There are obtained 199.7 g of a yellow crystalline product consisting of a mixture of compounds containing 26% (113a), 26% (116b) and 36% (116c).

Example 17

A mixture of compounds of the formulae (112a)

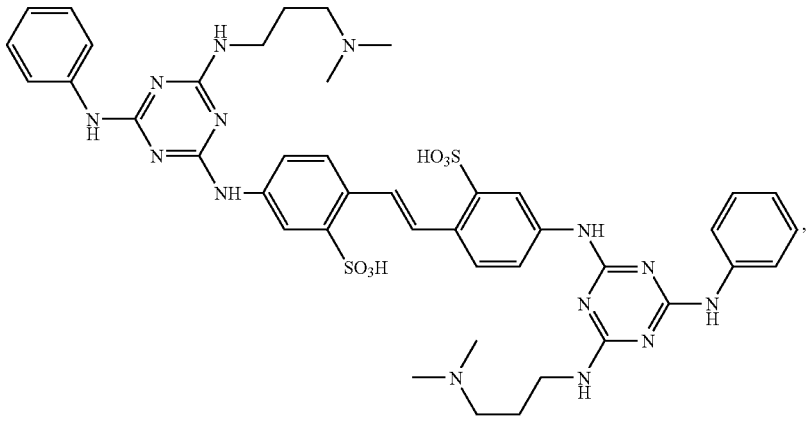

-continued (117b)

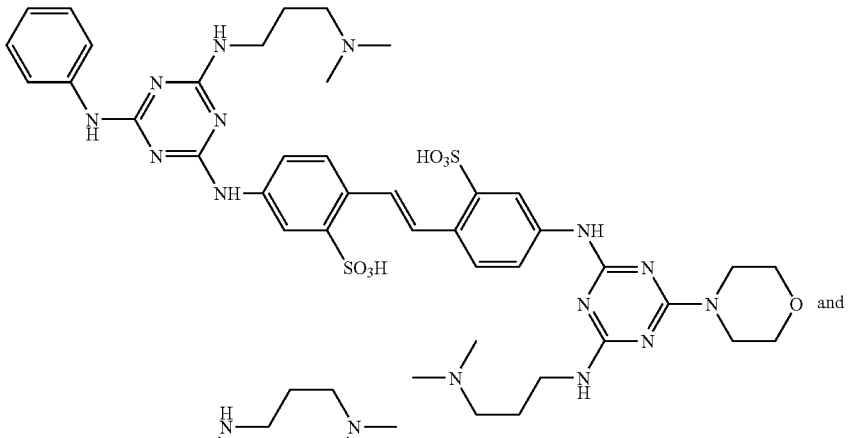

and (101)

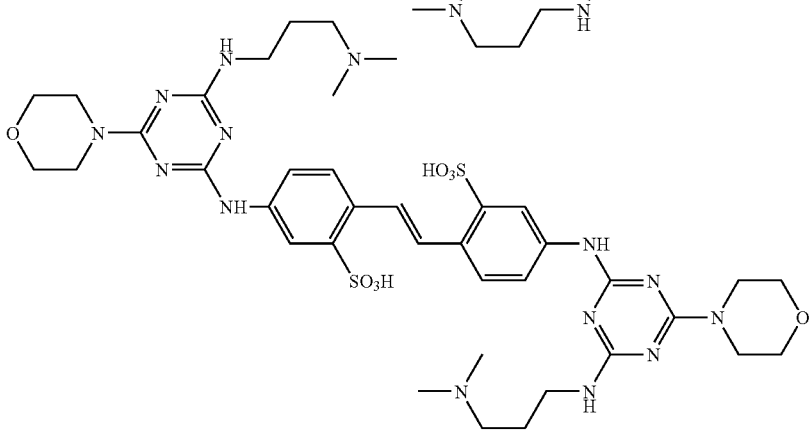

30.0 g of the mixture of compounds of formulae (113a), (113b) and (101a), obtained as described in Example 13, are added with stirring over 20 minutes at 45° C. to 100 ml of 3-N,N-dimethylamino-1-propylamine. The mixture is warmed to 120° C. and stirred for a further 1 hour at this temperature. After cooling to 90° C., 100 ml of water are added and the reaction mixture evaporated on a rotary evaporator. The residue is dissolved in 250 ml of water, the pH adjusted to 5 by addition of concentrated hydrochloric acid and the precipitated solids filtered, washed with water and dried under vacuum at 70° C. There are obtained 27.2 g of a yellow crystalline product, which is a mixture of compounds containing 26% (112a), 45% (117b) and 23% (101).

Example 18

(118)

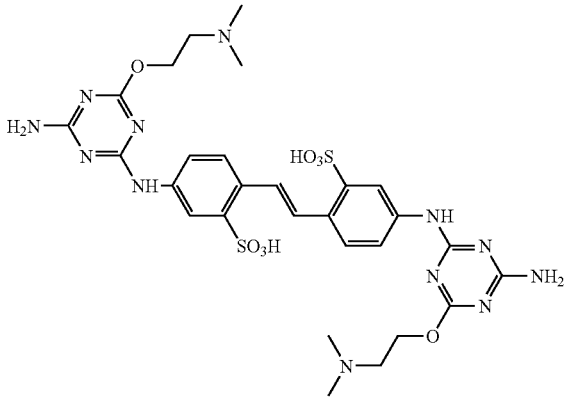

By following the procedure described in Example 15, but replacing the 4,4'-bis [(4-anilino-6-chloro-1,3,5-triazin-2-yl) amino]stilbene-2,2'-disulphonic acid disodium salt by 30 g of 4,4'-bis [(4amino-6-chloro-1,3,5-triazin-2-yl)amino]stilbene-2,2'-disulphonic acid disodium salt, obtained by an analogous process to that described for compound (101a) in Example 1, there are obtained 30.0 g of the compound of formula (118) as yellow crystals.

Example 19

(119)

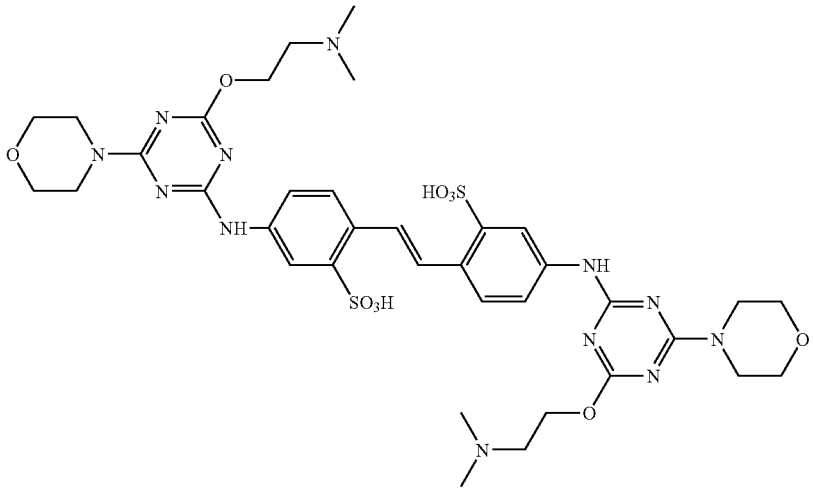

By following the procedure described in Example 15, but replacing the 4,4'-bis [(4-anilino-6-chloro-1,3,5-triazin-2-yl) amino]stilbene-2,2'-disulphonic acid disodium salt by 30 g of 4,4'-bis [(4-N-morpholino-6-chloro-1,3,5-triazin-2-yl) amino]stilbene-2,2'-disulphonic acid disodium salt (101a), there are obtained 30.0 g of the compound of formula (119) as yellow crystals.

Example 20

A mixture of compounds of the formulae (115)

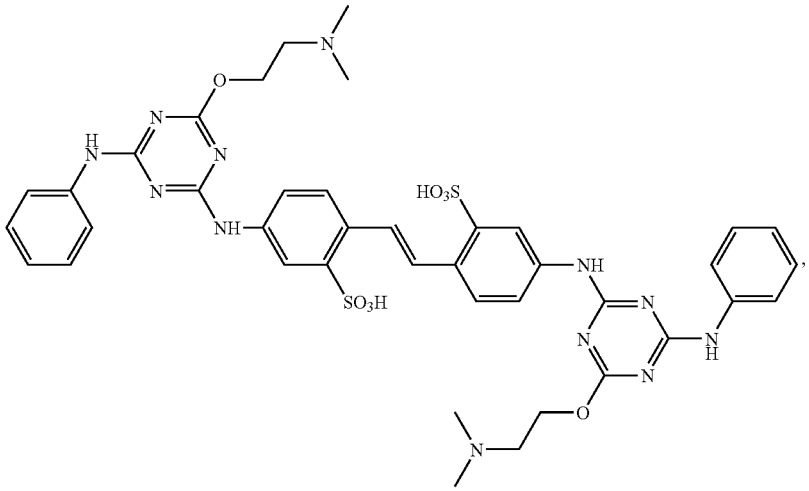

-continued (120b)

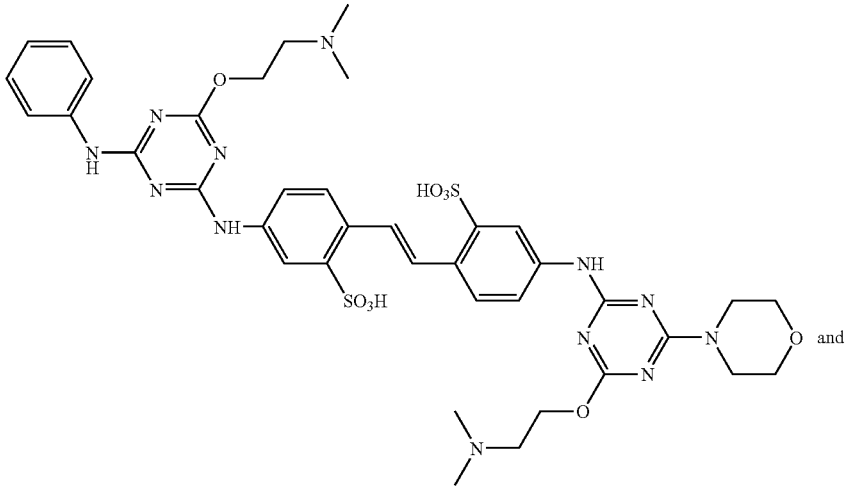

and (119)

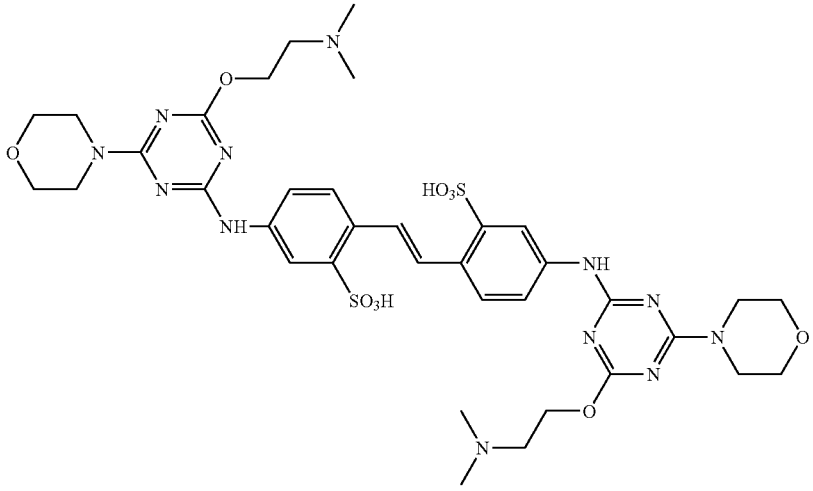

30.0 g of the mixture of compounds of formulae (113a), (113b) and (113c), obtained as described in Example 13, are added with stirring over 45 minutes at 80° C. to 100 ml of 2-N,N-dimethylamino-1-ethanol. The mixture is stirred for a further 2 hours at 80° C. and then diluted with 100 ml of water and the reaction mixture evaporated on a rotary evaporator. The residue is dissolved in 100 ml of water, the pH adjusted to 5.5 by addition of 10 ml of concentrated hydrochloric acid and the supernatant liquid decanted off. The residue is ground in a mortar with 150 ml of 5% brine, stirred overnight and the precipitated solids filtered, washed with 5% brine water and dried under vacuum at 70° C. There are obtained 28.6 g of a yellow crystalline product, which is a mixture of compounds containing 21% (115), 35% (120b) and 19% (119).

Example 21
A mixture of compounds of the formulae
(115)
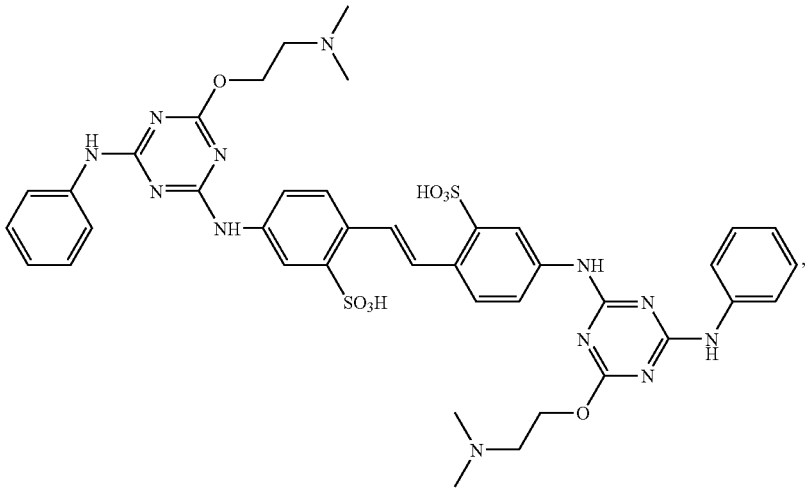
(121b)
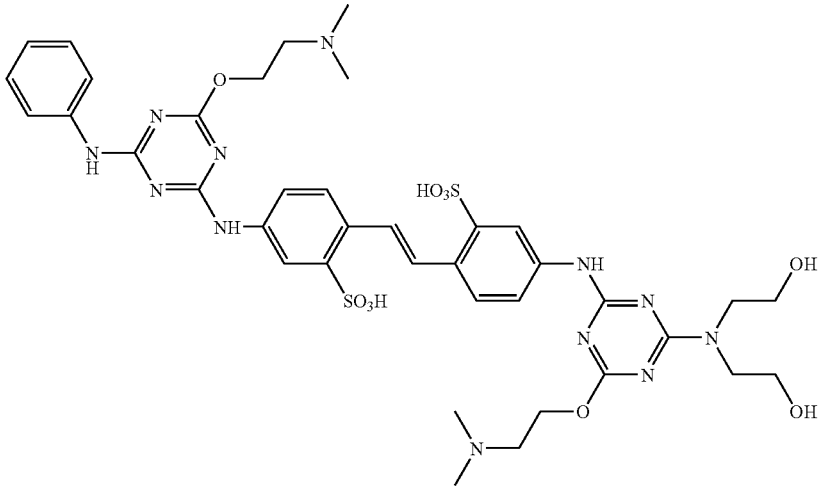
and
(121c)
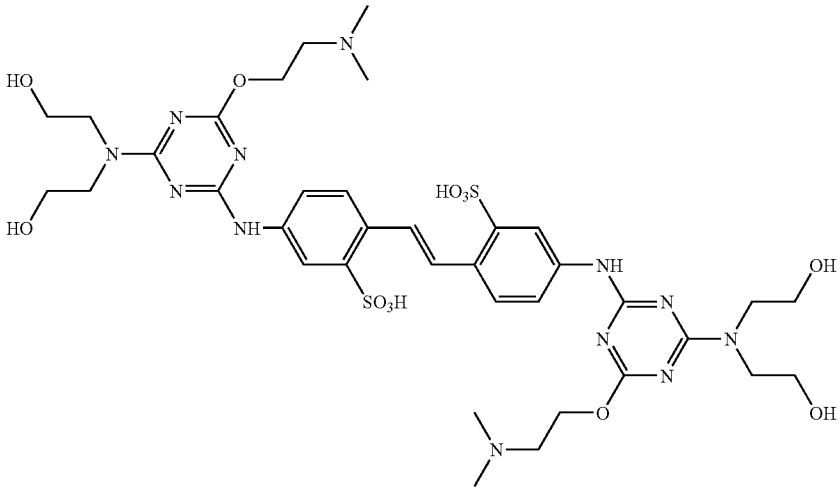

By following the procedure described in Example 20, but replacing the 30.0 g of the mixture of compounds of formulae (113a), (113b) and (113c) by 30.0 g of the mixture of compounds of formulae (114a), (114b) and (114c), prepared as described in Example 14, there are obtained 27.3 g of a mixture of compounds containing 26% (115), 39% (121 b) and 29% (121c) in yellow crystalline form.
Example 22
A mixture of compounds of formulae
(113a)
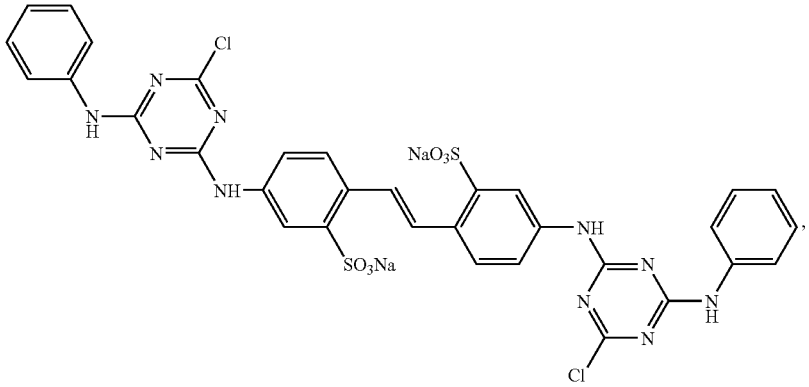
(122b)
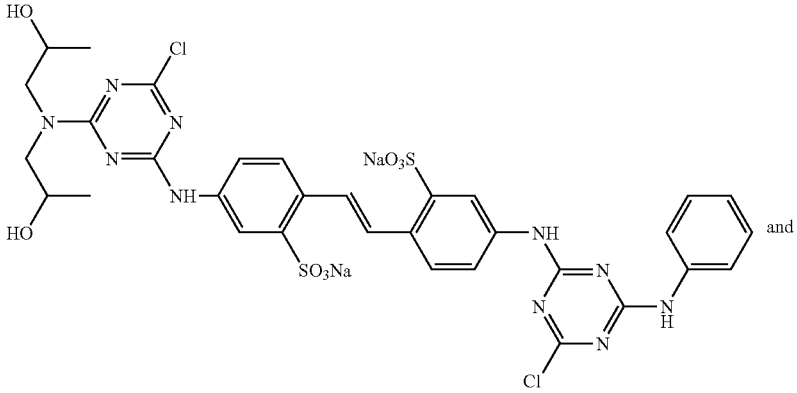
and
(122c)
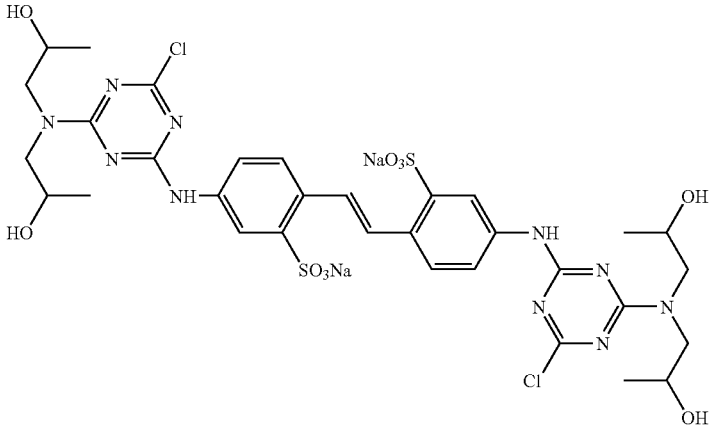

By following the procedure described in Example 13, but replacing the morpholine by an equivalent quantity of di-isopropanolamine, 210.5 g of a mixture of compounds containing 31% of the compound of formula (113a), 45% (122b) and 20% (122c) is obtained, as yellow crystals.

Example 23

A mixture of compounds of formulae (113a)

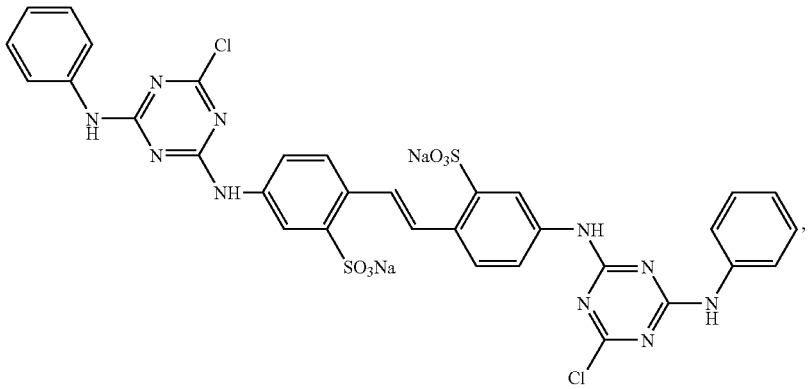

(123b)

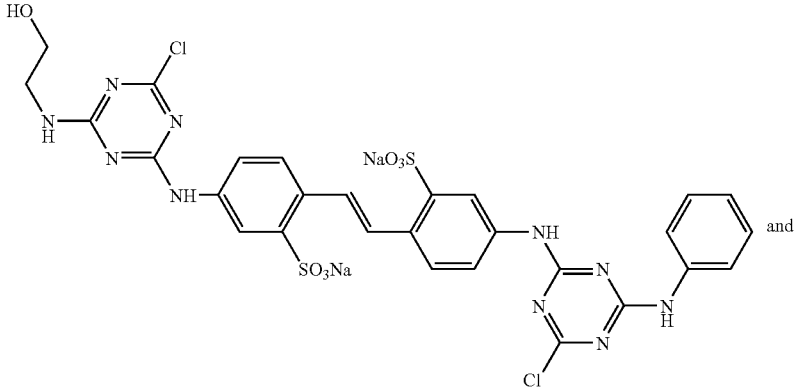

and (123c)

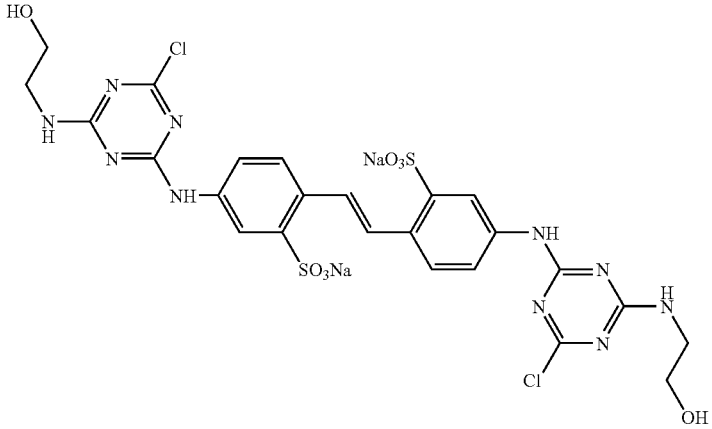

By following the procedure described in Example 13, but replacing the morpholine by an equivalent quantity of mono-ethanolamine, 244 g of a mixture of compounds containing 26% of the compound of formula (113a), 40% (123b) and 33% (123c) is obtained, as yellow crystals.

Example 24

(124)

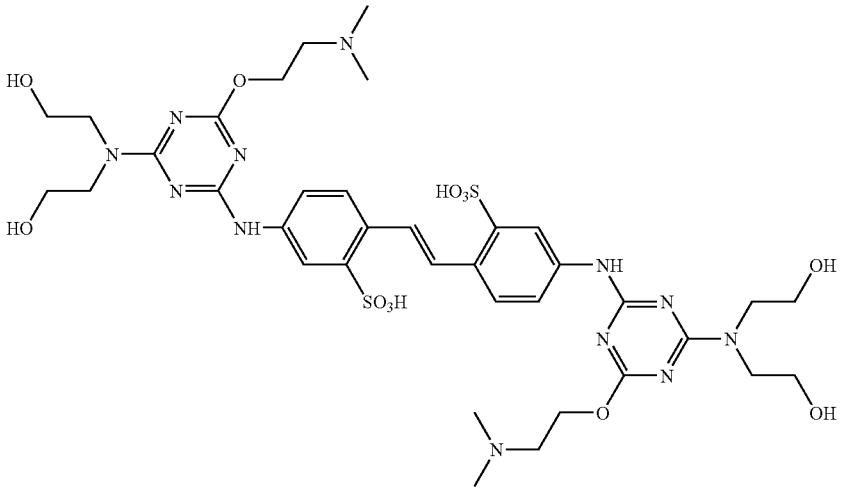

By following the procedure described in Example 15, but replacing the 4,4'-bis [(4-anilino-6-chloro-1,3,5-triazin-2-yl) amino]stilbene-2,2'-disulphonic acid disodium salt by 30 g 4,4'-bis [(4-bis-(2-hydroxethyl)amino-6-chloro-1,3,5-triazin-2-yl)amino]stilbene-2,2'-disulphonic acid disodium salt, there are obtained 27.3 g of the compound of formula (124) as yellow crystals.

Example 25

(125)

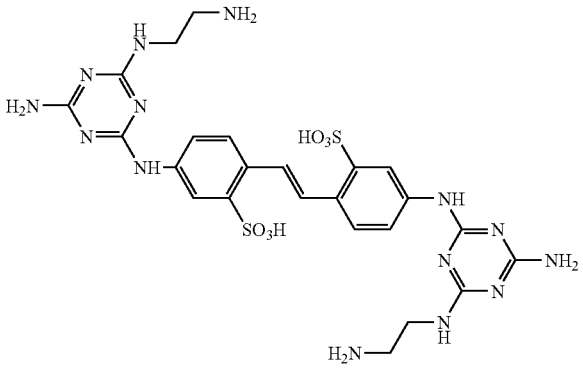

To a stirred mixture of 150 ml of water, 150 ml of dioxane and 40.7 g of ethylene diamine, heated to 70-75° C., 40.0 g of 4,4'-bis [(4-amino-6-chloro-1,3,5-triazin-2-yl)amino]stilbene-2,2'-disulphonic acid disodium salt are added over 30 minutes. The brown solution is then heated to 88° C. and stirring continued for a further 2 hours. After cooling to 70° C., the pH is adjusted to 5.5 by addition of 115 ml of concentrated hydrochloric acid and the precipitated solids filtered at 60° C. and washed with a little water. The filter cake is suspended in 350 ml of water, 50% aqueous sodium hydroxide solution added to pH 11 and the resulting yellow solution stirred for 1 hour. The pH is adjusted to 5 by addition of concentrated hydrochloric acid, the yellow precipitate filtered, washed with water and dried under vacuum at 70° C. There are obtained 31.5 g of the compound of formula (125) as yellow crystals.

Example 26

(126)

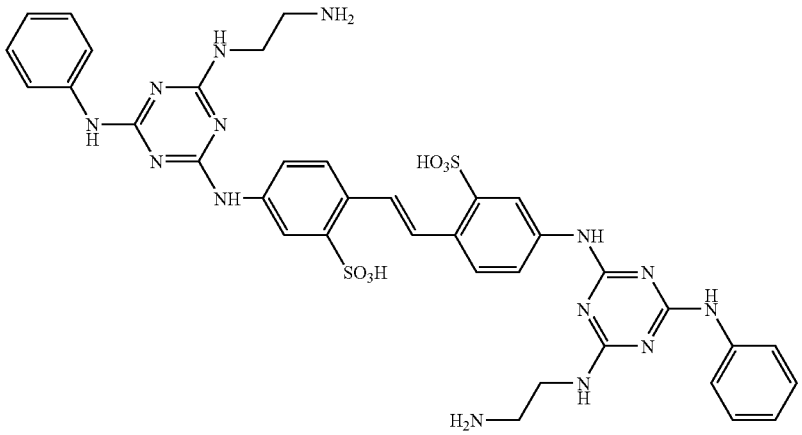

By proceeding essentially as described in Example 25, but replacing the 40.0 g of 4,4'-bis [(4-amino-6-chloro-1,3,5-triazin-2-yl)amino]stilbene-2,2'-disulphonic acid disodium salt by 40.0 g of 4,4'-bis [(4-anilino-6-chloro-1,3,5-triazin-2-yl)amino]stilbene-2,2'-disulphonic acid disodium salt, there are obtained 30.4 g of the compound of formula (126) as yellow crystals.

Example 27

(127)

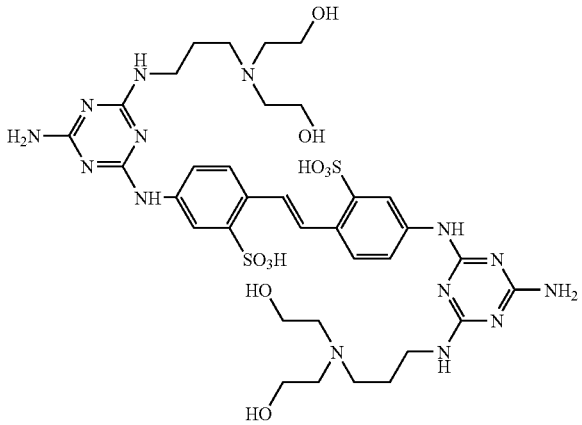

By proceeding essentially as described in Example 25, but replacing the 40.7 g of ethylene diamine by 91.6 g of N-(3-aminopropyl)diethanolamine, there are obtained 50.4 g of the compound of formula (127) as yellow crystals.

Example 28
A mixture of compounds of formulae
(112a)
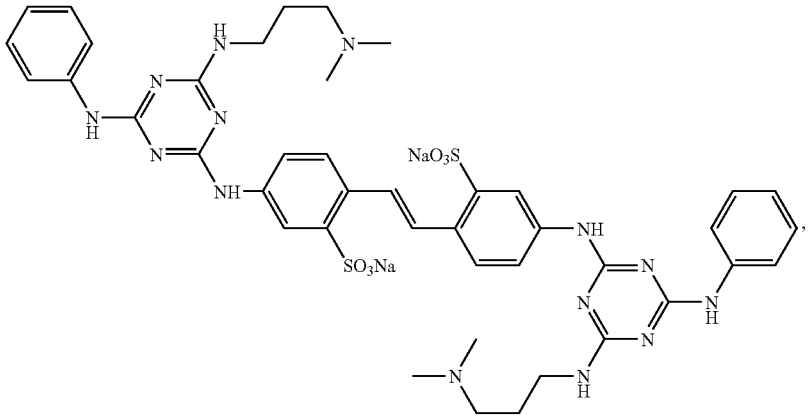
(128b)
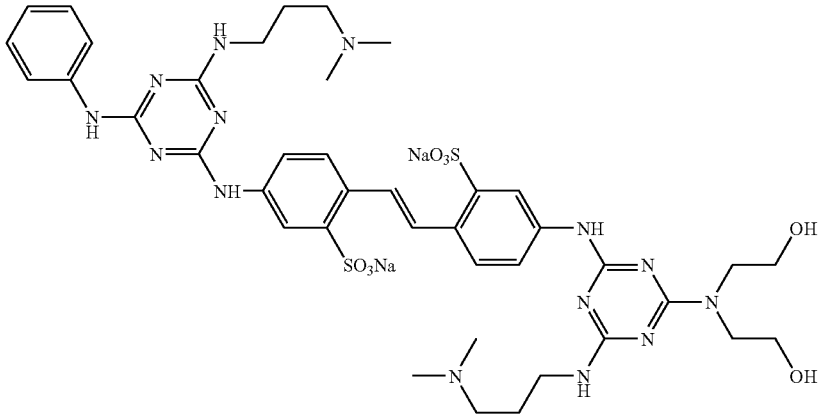
and
(102)
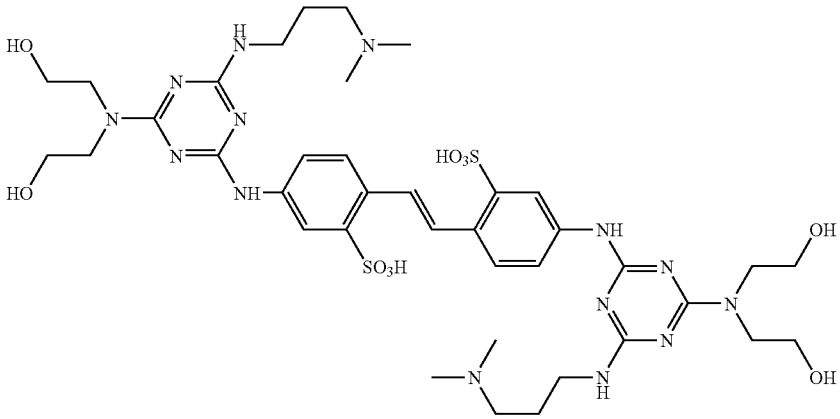
By reacting 40.0 g of the mixture of compounds of formulae (113a), (113b) and (113c), obtained as described in Example 13, with 100 ml of 3-N,N-dimethylamino-1-propylamine, essentially as described in Example 20, there are obtained 33.8 g of yellowish brown crystals of a mixture of compounds containing 25% of the compound of formula (112a), 39% (128b) and 27% (102).

Example 29

(129)

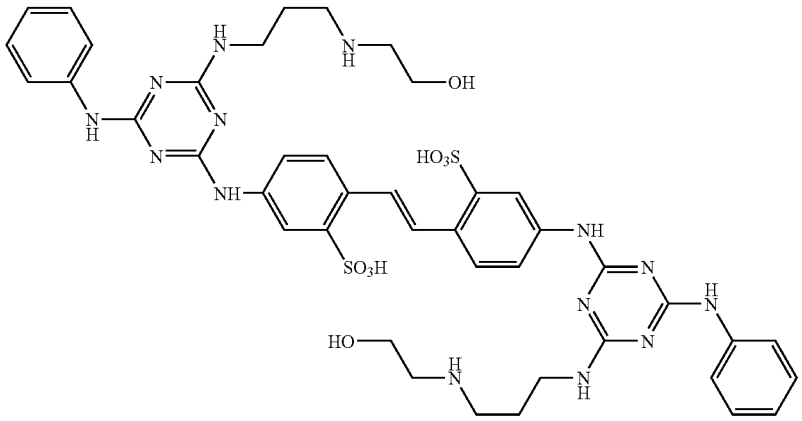

By proceeding essentially as described in Example 25, but replacing the 40.0 g of 4,4'-bis [(4-amino-6-chloro-1,3,5-triazin-2-yl)amino]stilbene-2,2'-disulphonic acid disodium salt by 40.0 g of 4,4'-bis [(4-anilino-6-chloro-1,3,5-triazin-2-yl)amino]stilbene-2,2'-disulphonic acid disodium salt and the 40.7 g of ethylene diamine by 68.1 g of 2-(3-aminopropylamino) ethanol, there are obtained 35.8 g of the compound of formula (129) as yellow crystals.

Example 30

(130)

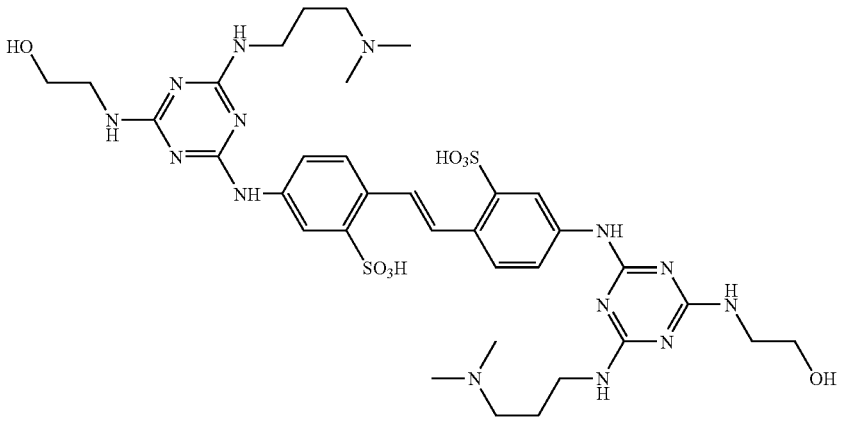

By proceeding essentially as described in Example 25, but replacing the 40.0 g of 4,4'-bis [(4-amino-6-chloro-1,3,5-triazin-2-yl)amino]stilbene-2,2'-disulphonic acid disodium salt by 35.0 g of 4,4'-bis [(4-ethanolamino-6-chloro-1,3,5-triazin-2-yl)amino]stilbene-2,2'-disulphonic acid disodium salt and the 40.7 g of ethylene diamine by 47.0 g of 3-N,N-dimethylamino-1-propylamine, there are obtained 39.3 g of the compound of formula (130) as yellow crystals.

Example 31
(131)
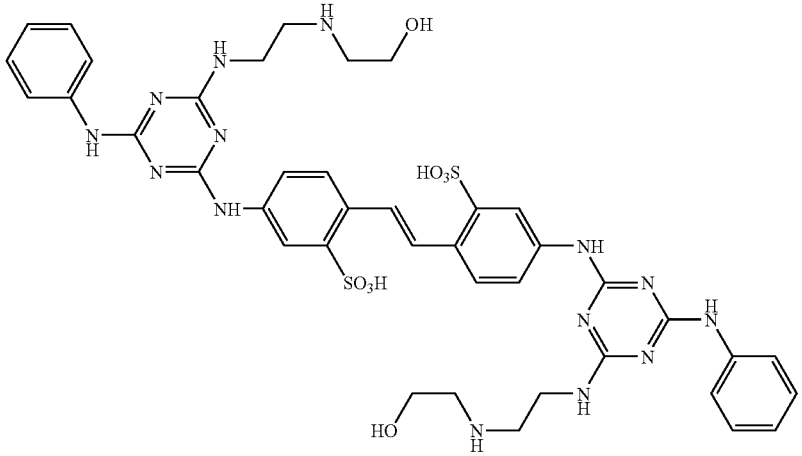
Treatment of 30.0 g of 4,4'-bis [(4-anilino-6-chloro-1,3,5-triazin-2-yl)amino]stilbene-2,2'-disulphonic acid disodium salt with 90 ml of N-(2-hydroxyethyl) ethylene diamine, essentially as described in Example 9, results in 28.0 g of the compound of formula (131) as beige crystals.
Example 32
A mixture of compounds of formulae
(113a)
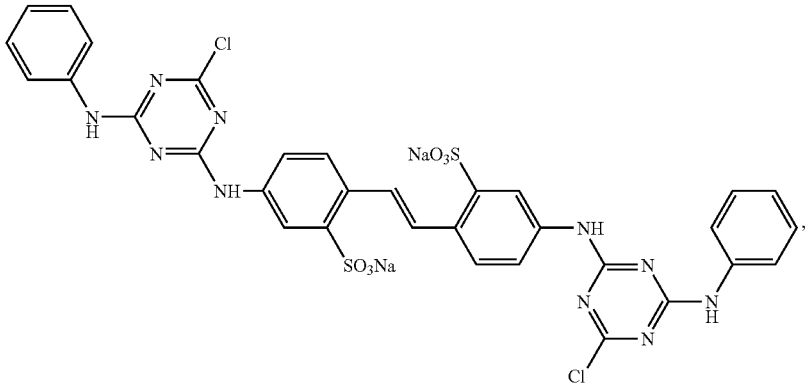
(132b)
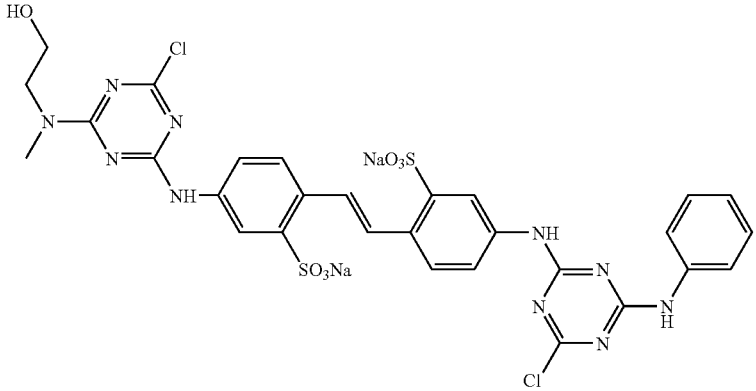
and -continued
(132c)
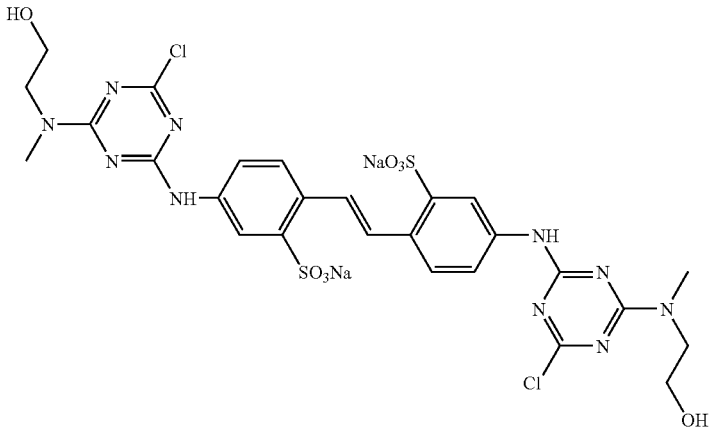
By following the procedure described in Example 13, but replacing the morpholine by an equivalent quantity of 2-N-methylaminoethanol, 213.3 g of a mixture of compounds containing 26% of the compound of formula (113a), 34% (132b) and 32% (132c) is obtained, as yellow crystals.
Example 33
A mixture of compounds of formulae
(113a)
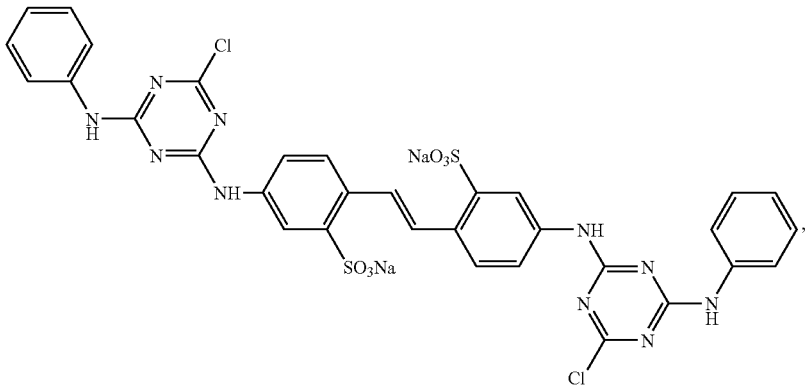
(133b)
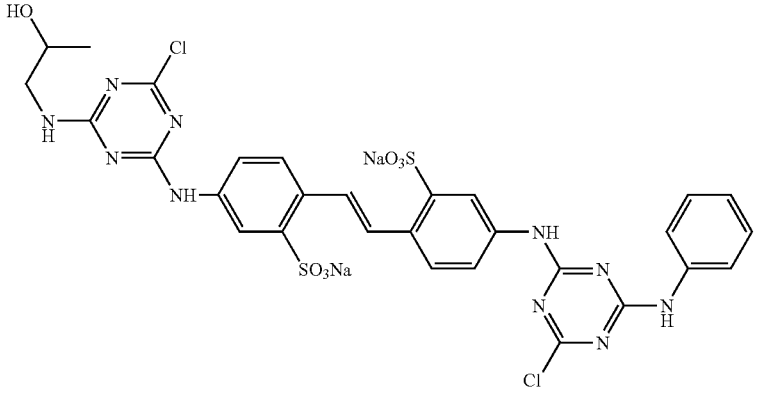
and -continued (133c)

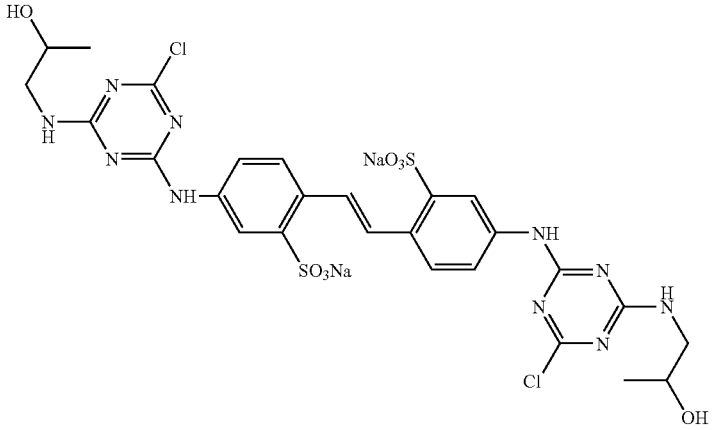

By following the procedure described in Example 13, but replacing the morpholine by an equivalent quantity of 1-aminopropan-2-ol, 188.5 g of a mixture of compounds containing 33% of the compound of formula (113a), 40% (133b) and 23% (133c) is obtained, as yellow crystals.

Example 34

(134)

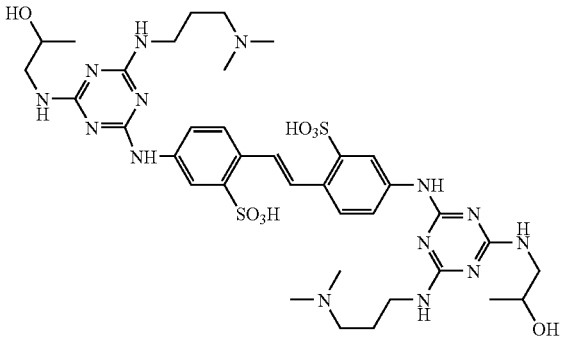

A solution of 120 g of cyanuric chloride in 930 ml of methyl ethyl ketone is added with stirring over 10 minutes at 5-10° C. to 400 g of ice/water. Then, during 70 minutes at a pH of from 4.5 to 5.0, 1083 g of a 12% solution of 4,4'-diaminostilbene-2,2'-disulphonic acid and sodium carbonate are added such that no excess of 4,4'-diaminostilbene-2,2'-disulphonic acid is present. The mixture is stirred for a further 10 minutes at 5-10° C., after which time a total of 29.8 ml of 20% aqueous sodium carbonate solution is consumed. The mixture is warmed to 10-20° C. and the pH adjusted to 7.0-7.5 by addition of 50% aqueous sodium hydroxide solution. 52.5 g of 1-amino propan-2-ol are then added drop wise over 10 minutes, the mixture warmed to 70° C. over 1 hour and stirring continued for a further 90 minutes at this temperature, the methyl ethyl ketone being distilled off, then cooled to 50° C. during 30 minutes, then to 25° C. during a further 30 minutes, stirred for a further 3 hours at this temperature and, finally, allowed to stand overnight at room temperature. The pH is maintained at 7.0-7.5 during the entire period, whereby a total of 53.4 ml of a solution of 50% aqueous sodium hydroxide solution is consumed. The precipitated solids are filtered washed with water, then with 2.5% brine and dried under vacuum at 7000. There are obtained 230.6 g of the compound of formula (134a)

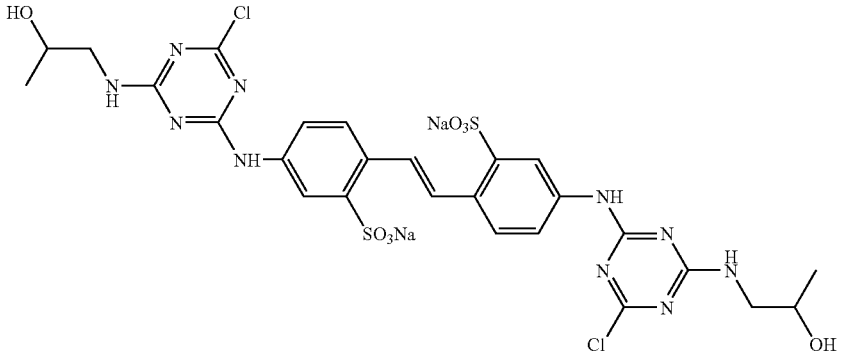

To a mixture of 150 ml of water, 150 ml of dioxane and 43.1 g of 3-N,N-dimethylamino-1-propylamine, previously warmed to 70° C., 35.0 g of the compound of formula (134a) are added with stirring. The yellowish brown solution is warmed to 86-88° C. and stirring continued for 90 minutes at this temperature. After cooling to 70° C., 100 ml of water are added and the pH adjusted to 5.0 by addition of 70 ml of concentrated hydrochloric acid. After adjusting the pH to 1.5 and cooling to 10° C., 25 g of sodium chloride are added and the mixture stirred overnight. The mixture is then evaporated on a rotary evaporator and the resulting viscous residue added in portions to 400 ml of acetone. The supernatant liquids are discarded and the procedure repeated until a crystalline product results. After filtering, the solids are stirred overnight in 200 ml of water, the supernatant liquids discarded, the residue evaporated on a rotary evaporator and finally dried under vacuum at 70° C. There are obtained 13.0 g of the compound of formula (134) as pale yellow crystals.

Example 35

(135)

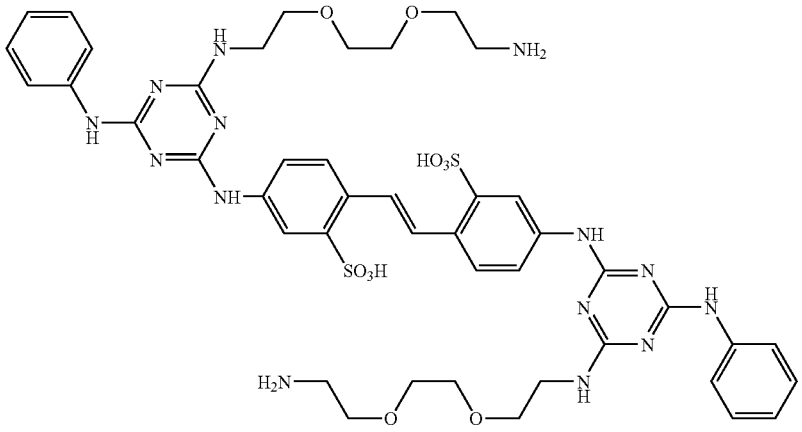

Treatment of 30.0 g of 4,4'-bis [(4-anilino-6-chloro-1,3,5-triazin-2-yl)amino]stilbene-2,2'-disulphonic acid disodium salt with 100 ml of 2,2'-(ethylenedioxy)-diethylene diamine, essentially as described in Example 9, results in 34.0 g of the compound of formula (135) as pale brown crystals.

Example 36

(136)

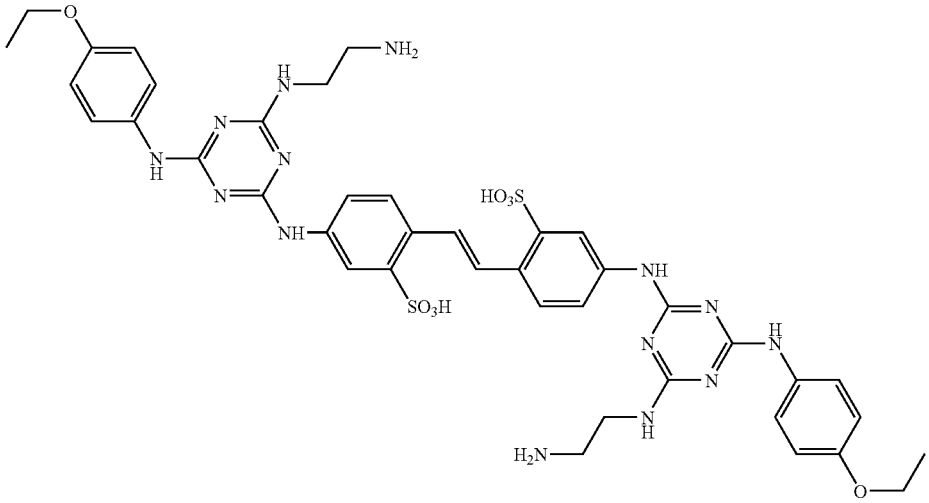

By following the procedure described in Example 1 for the preparation of the compound of formula (101a), but replacing the morpholine by an equivalent quantity of p-phenetidine, there are obtained 232.7 g of the compound of formula (136a)

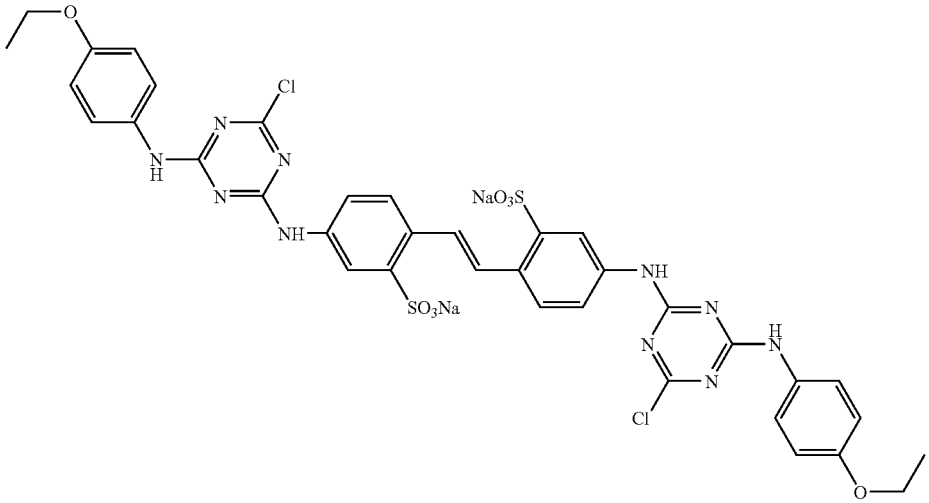

as greenish yellow crystals.

By proceeding essentially as described in Example 25, but replacing the 40.0 g of 4,4'-bis [(4-amino-6-chloro-1,3,5-triazin-2-yl)amino]stilbene-2,2'-disulphonic acid disodium salt by 35.0 g of the compound of formula (136a), 27.2 g of the compound of formula (136) are obtained as yellow crystals.

Example 37

(137)

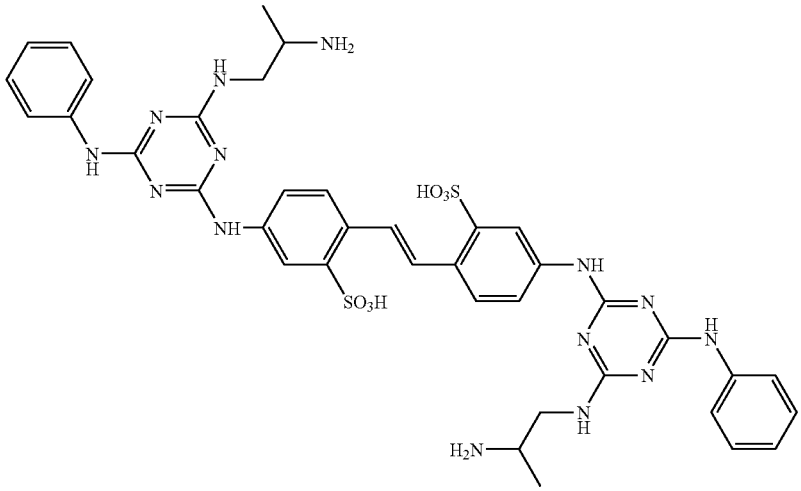

By proceeding essentially as described in Example 25, but replacing the 40.0 g of 4,4'-bis [(4-amino-6-chloro-1,3,5-triazin-2-yl)amino]stilbene-2,2'-disulphonic acid disodium salt by 40.0 g of 4,4'-bis [(4-anilino-6-chloro-1,3,5-triazin-2-yl)amino]stilbene-2,2'-disulphonic acid disodium salt and the 40.7 g of ethylene diamine by 35.5 g of 1,2-propylene diamine, there are obtained 34.7 g of the compound of formula (137) as yellow crystals.

Example 38

(138)

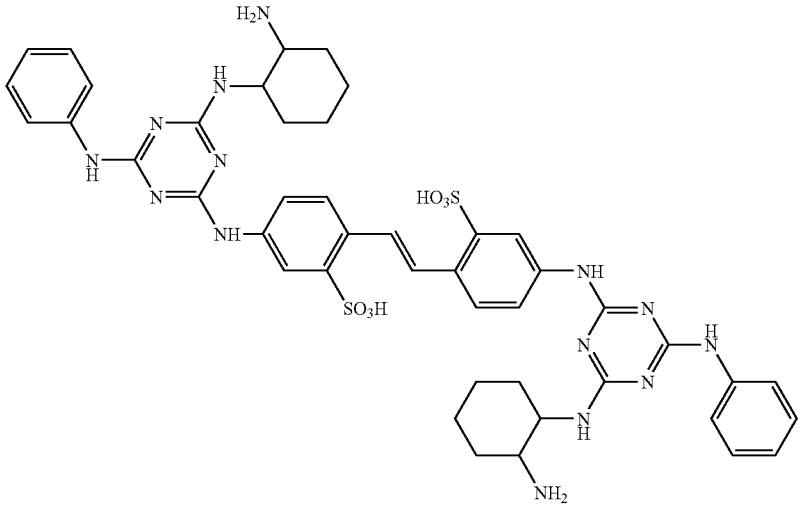

By proceeding essentially as described in Example 25, but replacing the 40.0 g of 4,4'-bis [(4-amino-6-chloro-1,3,5-triazin-2-yl)amino]stilbene-2,2'-disulphonic acid disodium salt by 30.0 g of 4,4'-bis [(4-anilino-6-chloro-1,3,5-triazin-2-yl)amino]stilbene-2,2'-disulphonic acid disodium salt and the 40.7 g of ethylene diamine by 48.3 g of 1,2-diamincyclohexane, there are obtained 27.1 g of the compound of formula (138) as yellow crystals.

Example 39

(139)

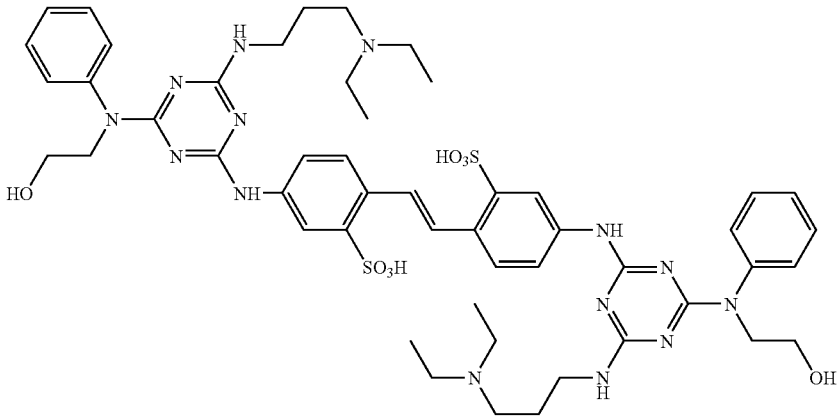

By proceeding essentially as described in Example 13, but replacing the mixture of 29.9 g of aniline and 28.0 g of morpholine by 89.1 g of 2-anilinoethanol, there are obtained 281.5 g of the compound of formula (139a)

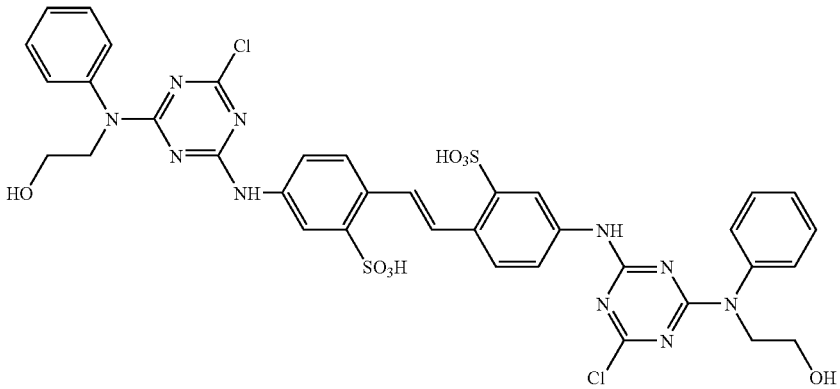

as yellow crystals.

To 150 ml of water, previously warmed to 70-75° C., 35.0 g of the compound of formula (139a) are added. The resulting yellow solution is then treated with 12.6 g of diethylamino-propylamine and the mixture stirred for 4 hours at 95-97° C., the pH being maintained at 10.0-10.5 by addition of a total of 1.5 ml of 4N aqueous sodium hydroxide solution. After cooling to 70° C., the pH is adjusted to 4.0 by addition of 6.5 ml of concentrated hydrochloric acid and the precipitated solids filtered, washed with water and dried under vacuum at 80° C. There are obtained 37.4 g of the compound of formula (139) as yellow crystals.

Example 40

(140)

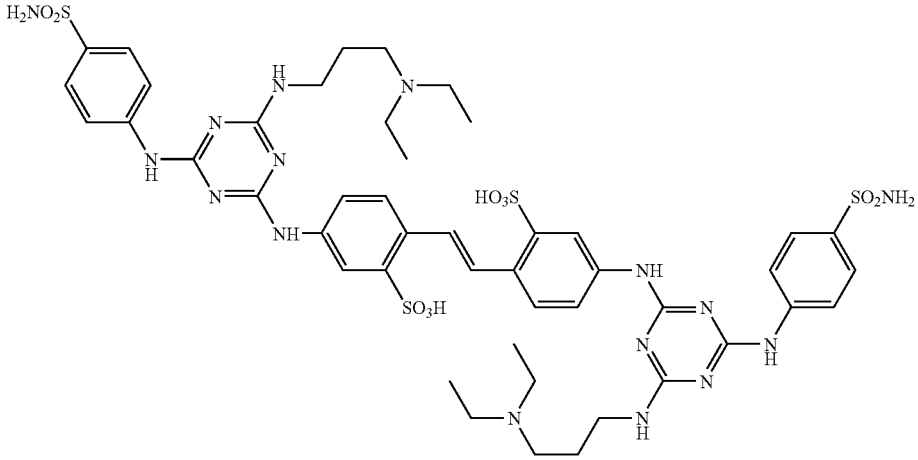

Treatment of 25.0 g of 4,4'-bis{[4-(4-sulphonamidoanilino)-6-chloro-1,3,5-triazin-2-yl]amino}stilbene-2,2'-disulphonic acid disodium salt (see Example 8) with 9.6 g of 3-diethylamino-1-propylamine by an analogous process to that described for compound (139) in the previous example, results in the formation of 24.0 g of the compound of formula (140) as yellow crystals.

Example 41

(141)

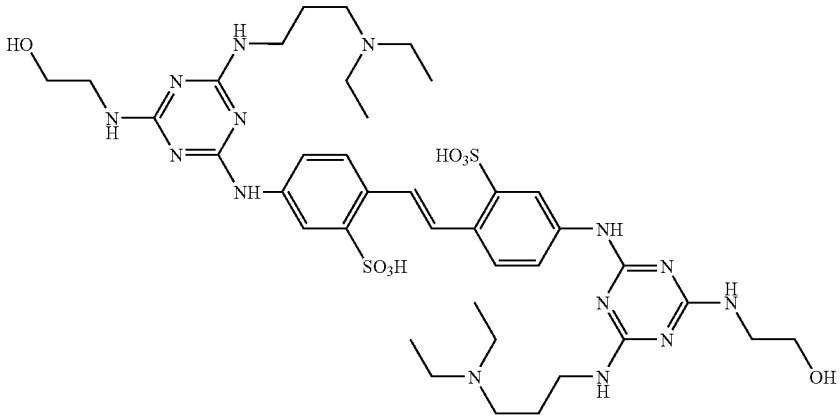

By proceeding essentially as described in Example 30, but replacing the 3-N,N-dimethylamino-1-propylamine by 3-N,N-diethylamino-1-propylamine, there are obtained 40.4 g of the compound of formula (141) as yellow crystals.

Example 42

(142)

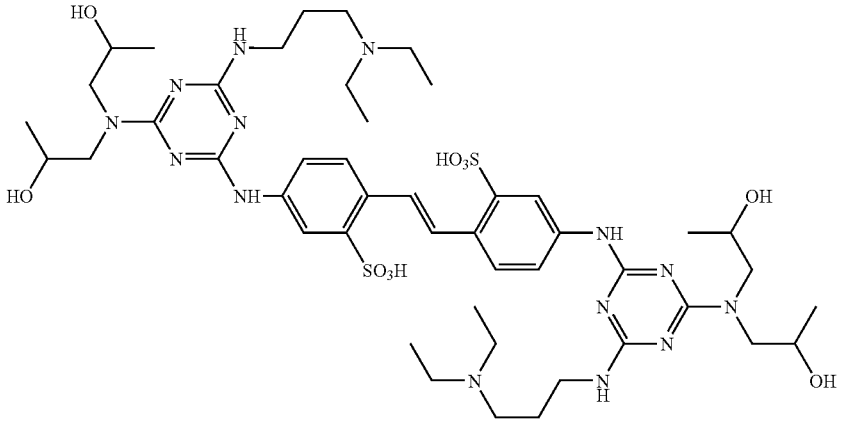

Treatment of 65.2 g of 4,4'-bis[(4-bis(2-hydroxy-n-propyl)amino-6-chloro-1,3,5-triazin-2-yl)amino]stilbene-2,2'-disulphonic acid disodium salt (see Example 3) with 13.9 g of 3-diethylamino-1-propylamine by an analogous process to that described for compound (139) in Example 39, results in the formation of 28.8 g of the compound of formula (142) as yellow crystals.

Example 43

(143)

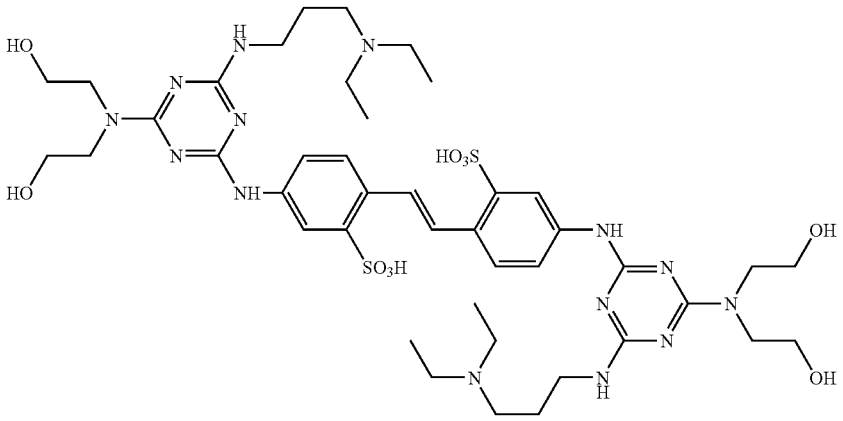

Treatment of 25 g of 4,4'-bis [(4-bis-(2-hydroxethyl) amino-6-chloro-1,3,5-triazin-2-yl)amino]stilbene-2,2'-disulphonic acid disodium salt (see Example 2) with 11.6 g of 3-diethylamino-1-propylamine by an analogous process to that described for compound (139) in Example 39, results in the formation of 24.1 g of the compound of formula (143) as yellow crystals.

Example 44

(144)

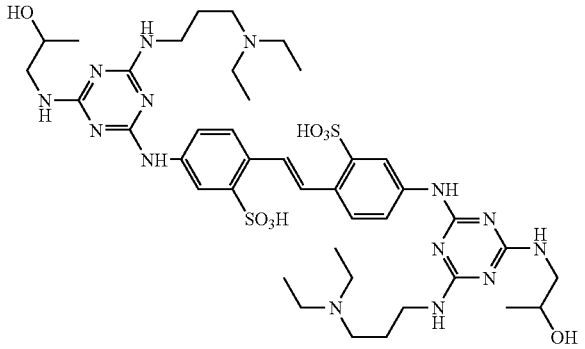

Treatment of 25 g of the compound of formula (134a) (see Example 34) with 9.95 g of 3-diethylamino-1-propylamine by an analogous process to that described for compound (139) in Example 39, results in the formation of 24.6 g of the compound of formula (144) as yellow crystals.

Example 45

(145)

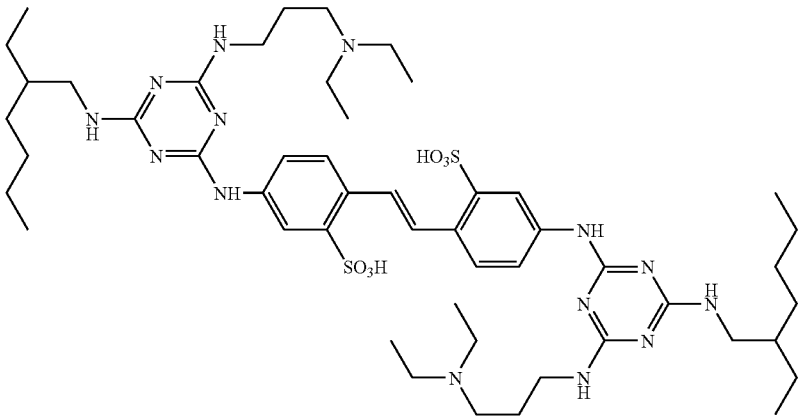

By proceeding essentially as described in Example 13, but replacing the mixture of 29.9 g of aniline and 28.0 g of morpholine by 84.0 g of 2-ethyl-1-hexylamine, there are obtained 270.7 g of the compound of formula (145a)

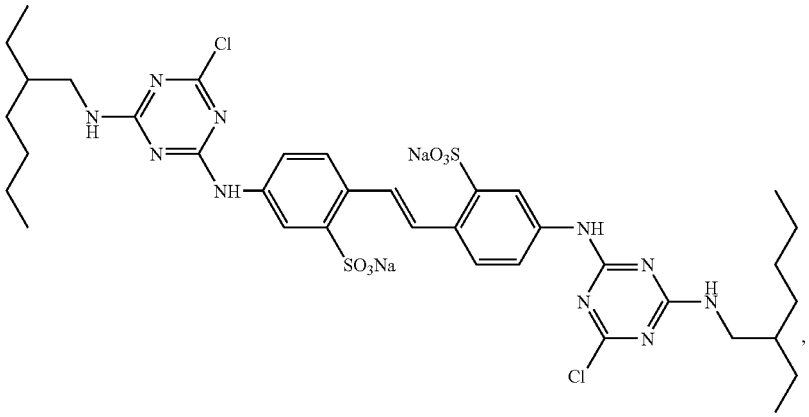

as yellowish beige crystals.

Treatment of 25.0 g of the compound of formula (145a) with 10.5 g of 3-diethylamino-1-propylamine by an analogous process to that described for compound (139) in Example 39, results in the formation of 26.7 g of the compound of formula (145) as pale yellow crystals.

Example 46

(146)

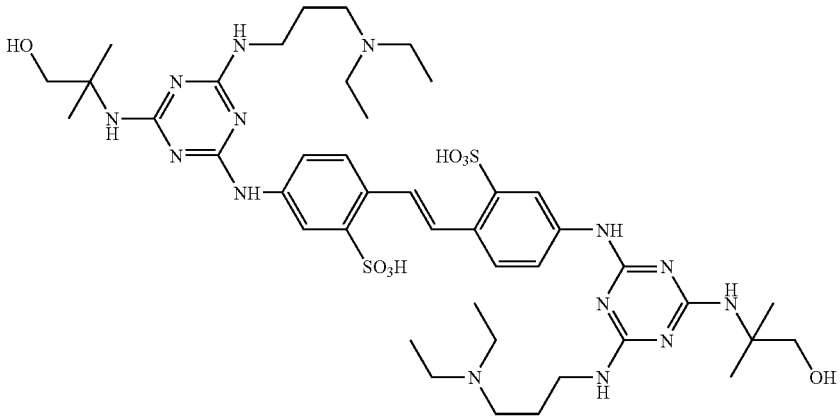

By proceeding essentially as described in Example 13, but replacing the mixture of 29.9 g of aniline and 28.0 g of morpholine by 64.3 g of 2-amino-2-methyl-1-propanol, there are obtained 162.4 g of the compound of formula (146a)

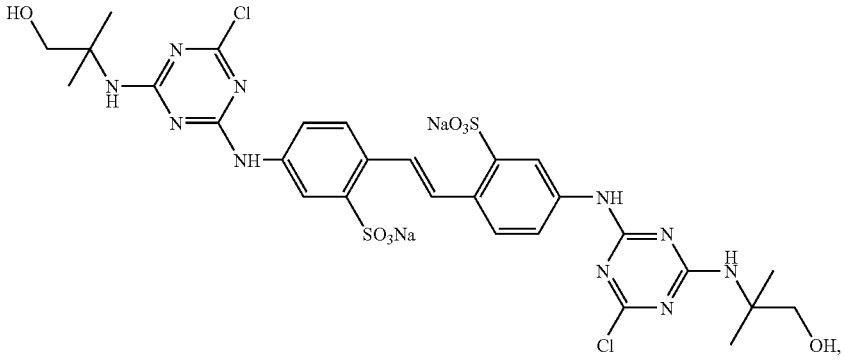

as yellow crystals.

Treatment of 25 g of the compound of formula (146a) with 11.6 g of 3-diethylamino-1-propylamine by an analogous process to that described for compound (139) in Example 39, results in the formation of 29.2 g of the compound of formula (146) as beige crystals.

Example 47

(147)

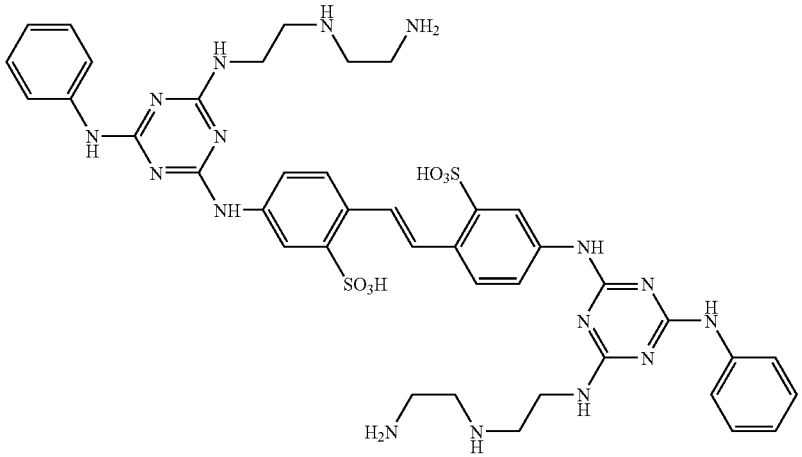

By proceeding essentially as described in Example 25, but replacing the 40.0 g of 4,4'-bis [(4-amino-6-chloro-1,3,5-triazin-2-yl)amino]stilbene-2,2'-disulphonic acid disodium salt by 35.0 g of 4,4'-bis [(4-anilino-6-chloro-1,3,5-triazin-2-yl)amino]stilbene-2,2'-disulphonic acid disodium salt and the 40.7 g of ethylene diamine by 44.6 g of diethylene triamine, there are obtained 37.1 g of the compound of formula (147) as yellow crystals.

Example 48
A mixture of compounds of formulae
(107)
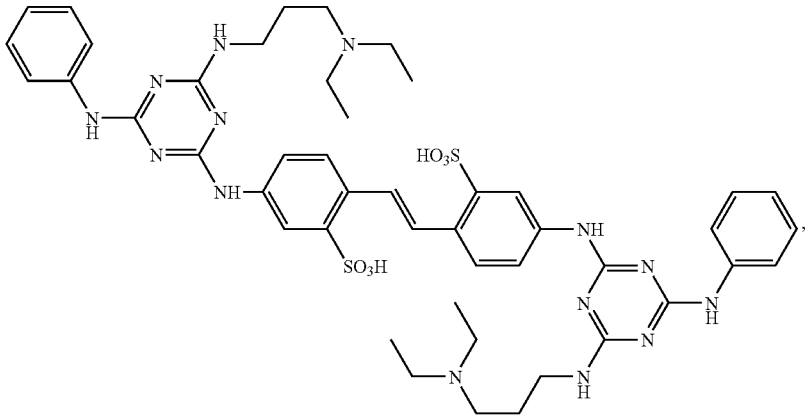
(148b)
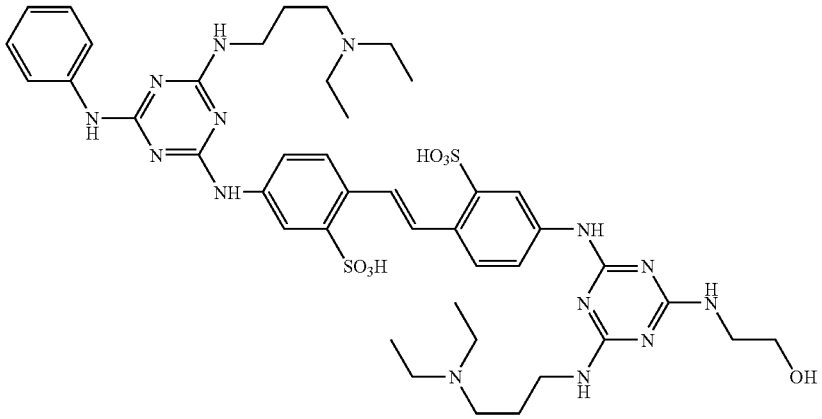
and
(130)
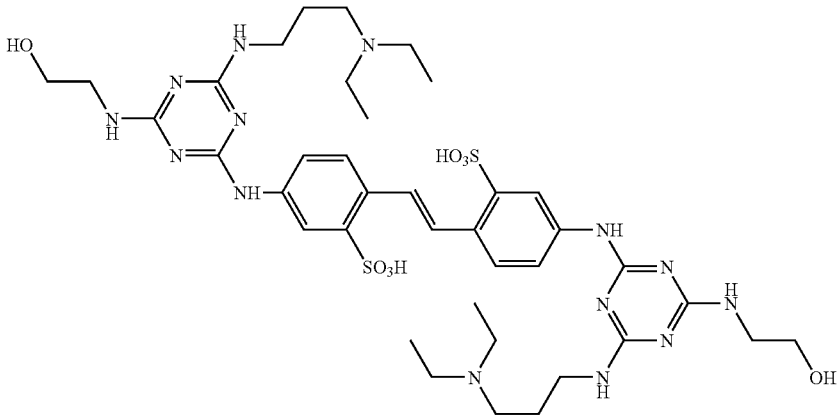

By reacting 25.0 g of the mixture of compounds of formulae (113a), (123b) and (123c), obtained as described in Example 23, with 11.9 g of 3-N,N-diethylamino-1-propylamine, by an analogous process to that described for compound (139) in Example 39, there are obtained 25.9 g of a mixture of compounds containing 29% of the compound of formula (107), 42% (148b) and 28% (130) as yellow crystals.

Application Examples

The various fluorescent whitening agents (FWA's) are dissolved in 25 ml of a 9:1 mixture of dimethyl sulphoxide/water, the pH adjusted to approximately 10 by addition of 4N aqueous sodium hydroxide solution and the solutions made up to 50 ml with water.

To a fibre dispersion consisting of 70 parts birch and 30 parts pine Kraft fibre with a degree of refining of 35° SR, 10% calcium carbonate (Hydrocarb 60) is added as filler. Sufficient of the FWA solutions are then added such that the FWA concentration, based on the weight of the pulp fibre, is 0.2%. The FWA is allowed to exhaust for 15 minutes, 0.03% of a cationic polyacrylamide (Percol 292) added as retention auxiliary and the hand sheet formed immediately by means of the Rapid-Koethen system.

The degrees of whiteness of the sheets (W CIE) are then measured by SCAN-P66-93 using a spectrophotometer.

The results of the measurements are summarized in the following Table 1.

TABLE 1

| Example Nr. | Compound Nr. | W (CIE) |
|---|---|---|
| | None | 70.1 |
| 49 | (137) | 132 |
| 50 | (109) | 131 |
| 51 | Mixture of Example 12 | 131 |
| 52 | (125) | 130 |
| 53 | (115) | 128 |
| 54 | (111) | 125 |
| 55 | (135) | 124 |
| 56 | (101) | 115 |
| 57 | (102) | 113 |
| 58 | (136) | 112 |

The above results clearly demonstrate the excellent whitening effects of the fluorescent whitening agents of the invention.

The invention claimed is:

1. A fluorescent whitening agent, which comprises a mixture of compounds of the formulae:

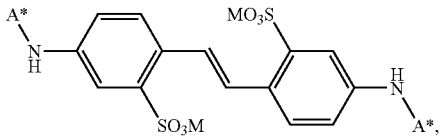

(1a)

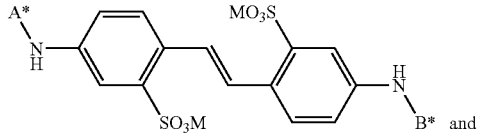

(1b) and

-continued

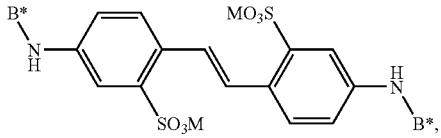

(1c)

in which

A* represents a group of the formula

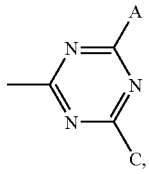

wherein

A represents —X—Y—$NR_3R_4$ and

C is —$NR_1R_2$ and

B* represents a group of the formula

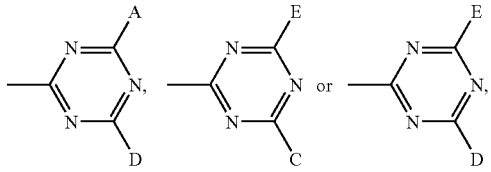

whereby the groups A* and B* are not identical, wherein

D represents —$NR_5R_6$ and

E represents —$X_1$—$Y_1$—$NR_7R_8$, whereby

X and $X_1$ each, independently of each other, represent —O— or —NH—,

Y and $Y_1$ each, independently of each other, represent a straight-chain $C_2$-$C_8$alkylene or branched $C_3$-$C_8$alkylene chain, which may be interrupted by one or two nitrogen, oxygen or sulphur atoms or represent a 5- or 6-membered cycloaliphatic ring, $R_1$, $R_2$, $R_5$ and $R_6$ each independently of each other, represent hydrogen, $C_1$-$C_8$alkyl, $C_2$-$C_4$hydroxyalkyl, $C_1$-$C_4$alkoxy$C_1$-$C_4$alkyl, phenyl, which is unsubstituted or substituted by halogen, $C_1$-$C_4$alkoxy, $C_1$-$C_4$alkyl or sulphonamido, or $R_1$ and $R_2$ and/or $R_5$ and $R_6$, together with the nitrogen atom to which they are attached, complete a morpholino- piperidino- or pyrrolidino-ring, $R_3$, $R_4$, $R_7$ and $R_8$, each independently of each other, represent hydrogen, $C_1$-$C_4$alkyl, $C_2$-$C_4$hydroxyalkyl or $R_3$ and $R_4$ and/or $R_7$ and $R_8$, together with the nitrogen atom to which they are attached, complete a morpholino-, piperidino- or pyrrolidino-ring and M represents hydrogen, an alkaline or alkaline earth metal, ammonium or alkylammonium.

2. A fluorescent whitening agent, according to claim 1, which comprises a mixture of compounds of the formulae
(1d)
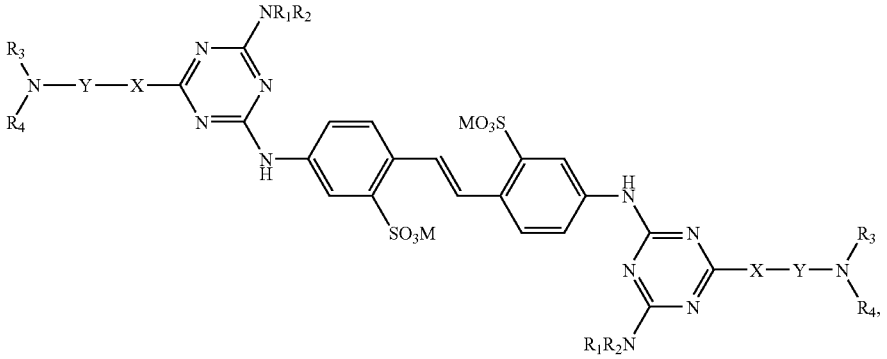
(1e)
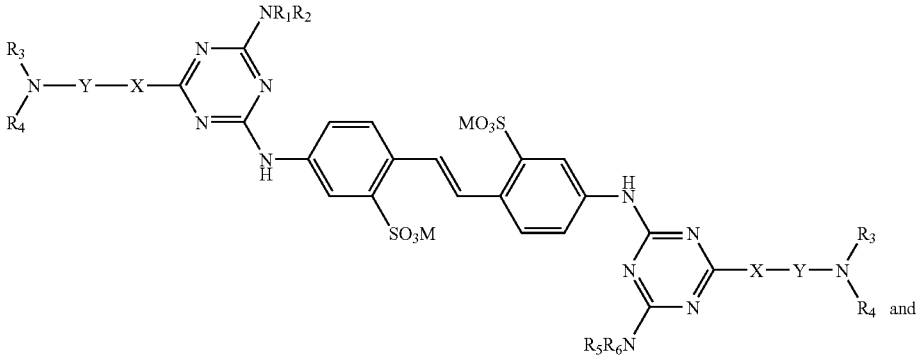
and
(1f)
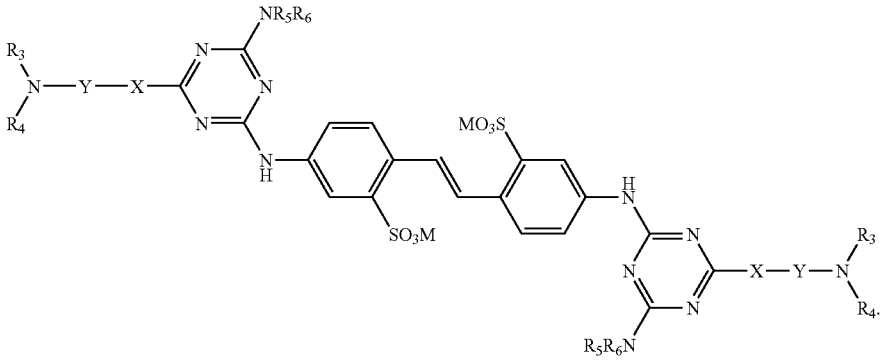

3. A fluorescent whitening agent, according to claim 1, which comprises a mixture of compounds of the formulae
(1d)
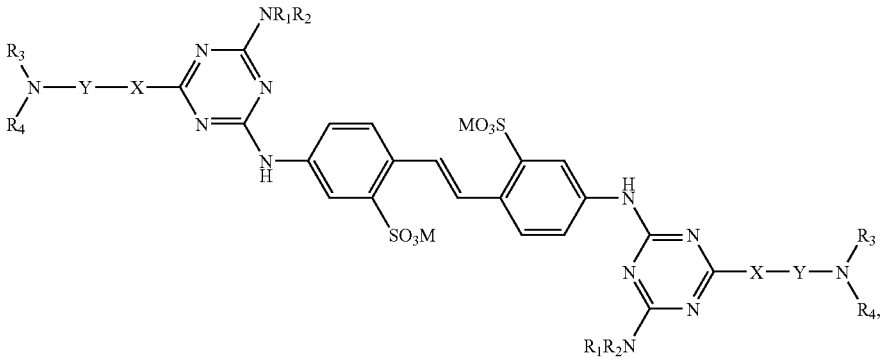
(1g)
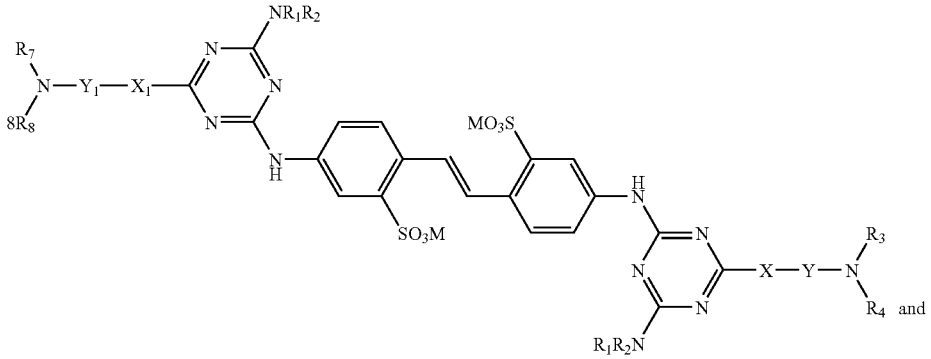
and
(1h)
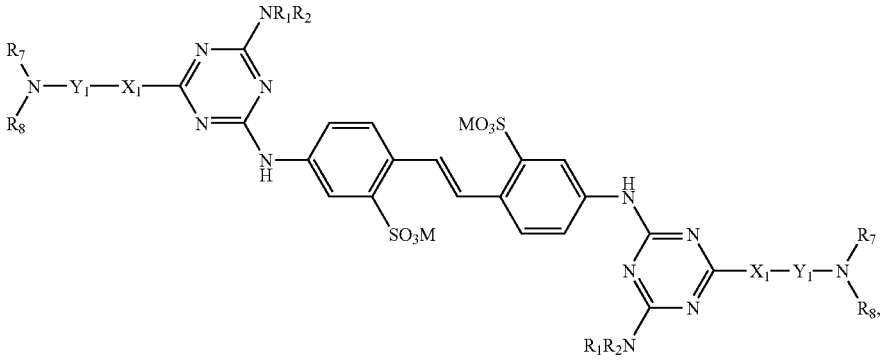

4. A compound of formula (2)

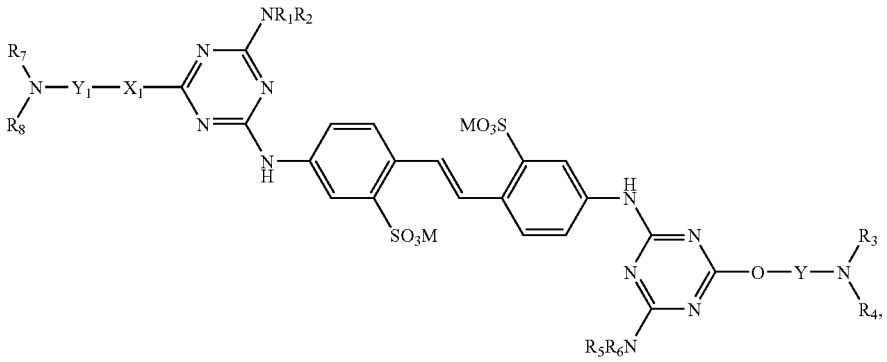

in which $X_1$, Y, $Y_1$, $R_1$, $R_2$, $R_3$, $R_4$, $R_5$, $R_6$, $R_7$, $R_8$ and M are as defined in claim 1.

5. A compound of the formula (3)

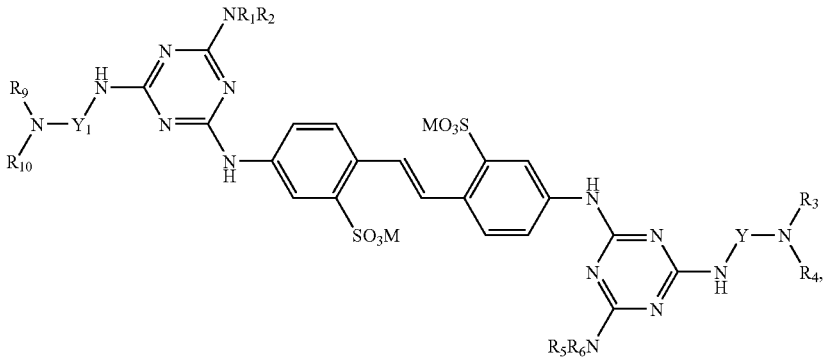

in which $R_9$ and $R_{10}$, each independently of each other, represent hydrogen or $C_2$-$C_4$hydroxyalkyl and Y and $Y_1$ each, independently of each other, represent a straight-chain $C_2$-$C_8$alkylene or branched $C_3$-$C_8$alkylene chain, which may be interrupted by one or two nitrogen, oxygen or sulphur atoms or represent a 5- or 6-membered cycloaliphatic ring, $R_1$, $R_2$, $R_5$ and $R_6$ each independently of each other, represent hydrogen, $C_1$-$C_8$alkyl, $C_2$-$C_4$hydroxyalkyl, $C_1$-$C_4$alkoxy$C_1$-$C_4$alkyl, phenyl, which is unsubstituted or substituted by halogen, $C_1$-$C_4$alkoxy, $C_1$-$C_4$alkyl or sulphonamido, or $R_1$ and $R_2$ and/or $R_5$ and $R_6$, together with the nitrogen atom to which they are attached, complete a morpholino- piperidino- or pyrrolidino-ring, $R_3$ and $R_4$ each independently of each other, represent hydrogen, $C_1$-$C_4$alkyl, $C_2$-$C_4$hydroxyalkyl or $R_3$ and $R_4$, together with the nitrogen atom to which they are attached, complete a morpholino-, piperidino- or pyrrolidino-ring and M represents hydrogen, an alkaline or alkaline earth metal, ammonium or alkylammonium with the proviso that when Y and $Y_1$ both represent —$CH_2CH_2CH_2$—, $R_1$ and $R_5$ are both phenyl and $R_2$ and $R_6$ are both hydrogen, $R_3$, $R_4$, $R_9$ and $R_{10}$ are not all —$CH_2CH_2OH$.

* * * * *